US009555984B2

(12) United States Patent
Takahata

(10) Patent No.: US 9,555,984 B2
(45) **Date of Patent: *Jan. 31, 2017**

(54) SHEET SEPARATING DEVICE

(71) Applicant: Brother Kogyo Kabushiki Kaisha, Nagoya-shi, Aichi-ken (JP)

(72) Inventor: Muneaki Takahata, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/750,144

(22) Filed: Jun. 25, 2015

(65) Prior Publication Data

US 2015/0375948 A1 Dec. 31, 2015

(30) Foreign Application Priority Data

Jun. 25, 2014 (JP) ..... 2014-129898

(51) Int. Cl.

| | |
|---|---|
| ***B65H 1/04*** | (2006.01) |
| ***B65H 3/52*** | (2006.01) |
| ***B65H 7/00*** | (2006.01) |

(52) U.S. Cl.

CPC ..... *B65H 1/04* (2013.01); *B65H 3/5238* (2013.01); *B65H 7/00* (2013.01);

(Continued)

(58) Field of Classification Search

CPC ..... B65H 3/5223; B65H 3/5238; B65H 2405/11425; B65H 2511/12; B65H 2405/1142; B65H 2405/114

See application file for complete search history.

(56) References Cited

U.S. PATENT DOCUMENTS

| | | | | |
|---|---|---|---|---|
| 5,863,036 | A | 1/1999 | Tanaka et al. | |
| 6,152,442 | A | 11/2000 | Nishinohara et al. | |
| 6,361,037 | B1 * | 3/2002 | Nakagawa | B65H 3/5246 271/10.11 |
| 7,703,763 | B2 | 4/2010 | Shiohara et al. | |
| 8,109,498 | B2 | 2/2012 | Akimatsu | |
| 9,079,731 | B2 * | 7/2015 | Takahata | B65H 3/0684 |
| 2006/0214355 | A1 * | 9/2006 | Fukao | B65H 3/0661 271/10.11 |
| 2006/0225585 | A1 * | 10/2006 | Shyu | B65H 3/5223 101/3.1 |
| 2011/0074087 | A1 | 3/2011 | Akimatsu | |
| 2011/0309569 | A1 * | 12/2011 | Huang | B65H 3/0684 271/109 |

(Continued)

FOREIGN PATENT DOCUMENTS

| | | |
|---|---|---|
| CN | 1156118 A | 8/1997 |
| GB | 2235438 A | 3/1991 |

(Continued)

OTHER PUBLICATIONS

Dec. 16, 2015—(CN) The First Office Action—App 201410243254.6.

(Continued)

*Primary Examiner* — Jeremy R Severson
(74) *Attorney, Agent, or Firm* — Banner & Witcoff, Ltd.

(57) ABSTRACT

A separation member separates a sheet, conveyed by a separation roller in a conveying direction, from remaining sheets supported by a support member. At least one of a first guide and a second guide is a movable guide which moves in a width direction orthogonal to the conveying direction to increase and decrease a distance therebetween. An urging member is retained, at one end thereof, by a base portion in an elastically deformed state and urges the separation member toward the separation roller. In response to the movable guide decreasing the distance between the first guide and the second guide, an engaging mechanism reduces elastic deformation of the urging member by moving the base portion in a first direction. In response to the movable guide increasing the distance, the engaging mechanism moves the base portion in a second direction opposite to the first direction.

15 Claims, 10 Drawing Sheets

(52) U.S. Cl.
CPC ..... *B65H 2403/513* (2013.01); *B65H 2405/11425* (2013.01); *B65H 2511/12* (2013.01); *B65H 2511/22* (2013.01); *B65H 2515/30* (2013.01)

(56) References Cited

U.S. PATENT DOCUMENTS

2014/0353905 A1* 12/2014 Takahata ..... B65H 3/0684
271/121

FOREIGN PATENT DOCUMENTS

| | | | |
|---|---|---|---|
| JP | H02291324 | A | 12/1990 |
| JP | H05-69955 | A | 3/1993 |
| JP | H09-67026 | A | 3/1997 |
| JP | H11-180568 | A | 7/1999 |
| JP | 2000-272765 | A | 10/2000 |
| JP | 2011-073814 | A | 4/2011 |

OTHER PUBLICATIONS

Aug. 29, 2014—(US) Non-Final Office Action—U.S. Appl. No. 14/294,233.
Mar. 4, 2015—(US) Notice of Allowance—U.S. Appl. No. 14/294,233.

* cited by examiner

SHEET SEPARATING DEVICE

CROSS-REFERENCE TO RELATED APPLICATION

This application claims priority from Japanese Patent Application No. 2014-129898, filed on Jun. 25, 2014, which is incorporated herein by reference in their entirety.

TECHNICAL FIELD

Aspects described herein relate to a sheet separating device.

BACKGROUND

A known sheet separating device includes a support member, a pair of guides, a separation roller, a separation member, and an urging member. The support member supports sheets to be conveyed in a conveying direction. The guides are disposed at the support member while facing each other, and movable relative to each other in a width direction orthogonal to the conveying direction so as to align the sheets with respect to the center of the support member in the width direction. The separation member is urged by the urging member toward the separation roller and separates a sheet from the remaining sheets supported by the support member. The separation roller conveys the separated sheet in the conveying direction.

In the sheet separating device, the separation member is pressed against the separation roller by the urging member, whereby a braking force is generated between the separation roller and the separation member. When two or more sheets are about to be conveyed by the separation roller, a single sheet that is in contact with the separation roller is separated from the other sheets by the braking force acting on the other sheets.

SUMMARY

In the known separating device, a constant urging force is set to be applied by the urging member to the separation member regardless of a width of sheets to be conveyed. The constant urging force, if set appropriately for sheets having a relatively narrow width, may cause conveyance of multiple sheets having a relatively large width, or the constant urging force, if set to be relatively strong, may cause fast wear of the separation member.

It may be beneficial for a sheet separating device to be configured to ensure stable separation performance for sheets having various widths while reducing or preventing wear of a separation member.

According to one or more aspects of the disclosure, a sheet separating device comprises a support member configured to support sheets to be conveyed in a conveying direction, a first guide and a second guide opposing each other with a distance therebetween in a width direction orthogonal to the conveying direction, a separation roller configured to rotate about a first axis and convey a sheet supported by the support member in the conveying direction, a separation member configured to separate the sheet conveyed by the separation roller from remaining sheets, a base portion, an urging member retained, at one end thereof, by the base portion in an elastically deformed state and urging the separation member toward the separation roller, and an engaging mechanism disposed between the movable guide and the base portion. At least one of the first guide and the second guide is a movable guide configured to move in the width direction to increase and decrease the distance between the first guide and the second guide. The engaging mechanism is configured to, in response to the movable guide decreasing the distance, reduce elastic deformation of the urging member by moving the base portion in a first direction and is configured to, in response to the movable guide increasing the distance, move the base portion in a second direction opposite to the first direction.

According to one or more aspects of the disclosure, a sheet separating device comprises a support member configured to support sheets to be conveyed in a conveying direction, a first guide and a second guide opposing each other with a distance therebetween in a width direction orthogonal to the conveying direction, a separation roller configured to rotate about a first axis and convey a sheet supported by the support member in the conveying direction, a separation member configured to separate the sheet conveyed by the separation roller from remaining sheets, a base portion, an urging member retained, at one end thereof, by the base portion and configured to urge the separation member toward the separation roller, and an engaging mechanism disposed between the movable guide and the base portion. At least one of the first guide and the second guide is a movable guide configured to move in the width direction to increase and decrease the distance between the first guide and the second guide. The engaging mechanism is configured to, in response to the movable guide decreasing the distance, reduce an urging force of the urging member by moving the base portion in a first direction and is configured to, in response to the movable guide increasing the distance between the first guide and the second guide, increase the urging force of the urging member by moving the base portion in a second direction opposite to the first direction.

According to one or more aspects of the disclosure, a sheet separating device comprises a support member configured to support sheets to be conveyed in a conveying direction, a first guide and a second guide opposing each other with a distance therebetween in a width direction orthogonal to the conveying direction, a separation roller configured to rotate about a first axis and convey a sheet supported by the support member in the conveying direction, a separation member configured to separate the sheet conveyed by the separation roller from remaining sheets, a base portion, an urging member retained, at one end thereof, by the base portion and configured to urge the separation member toward the separation roller, and an engaging mechanism disposed between the movable guide and the base portion. At least one of the first guide and the second guide is a movable guide configured to move in the width direction to increase and decrease the distance between the first guide and the second guide. The engaging mechanism is configured to, in response to the movable guide decreasing the distance, set an urging force of the urging member at a first level by moving the base portion in a first direction and is configured to, in response to the movable guide increasing the distance, set the urging force of the urging member at a second level greater than the first level by moving the base portion in a second direction opposite to the first direction.

DESCRIPTION OF THE DRAWINGS

Aspects of the disclosure are illustrated by way of example and not by limitation in the accompanying figures in which like reference characters indicate similar elements.

DETAILED DESCRIPTION

Hereinafter, first to fifth illustrative embodiments in which the disclosure is implemented will be described with reference to the accompanying drawings.

First Illustrative Embodiment

Figure 1:
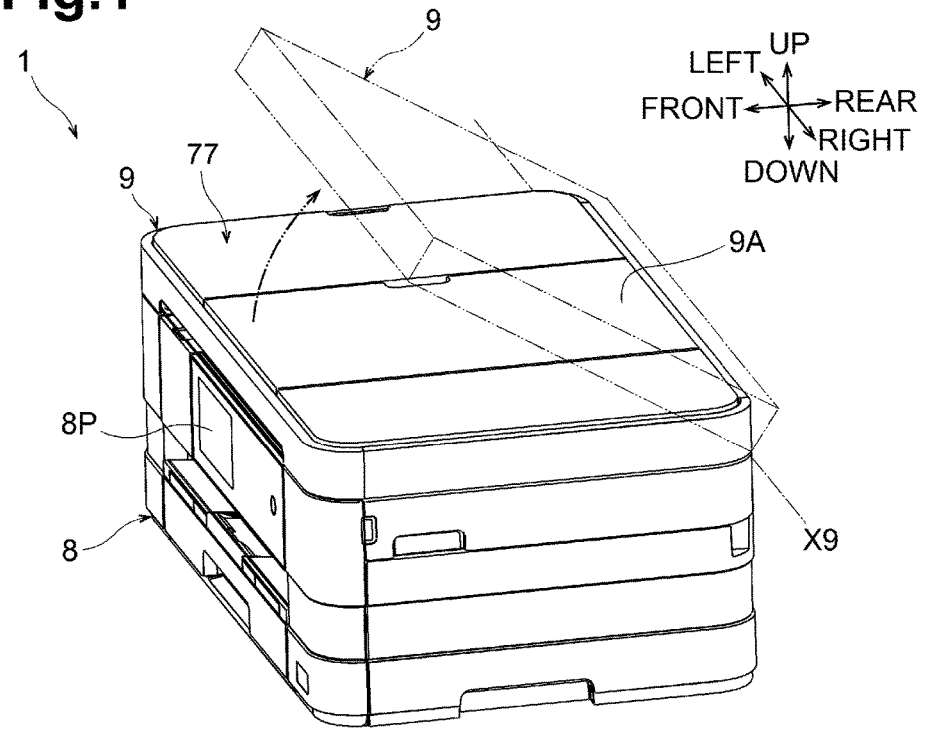
FIG. 1 is a perspective view depicting an image reading device in a first illustrative embodiment according to one or more aspects of the disclosure.

As depicted in FIG. 1, an image reading device 1 according to the first illustrative embodiment is an example of a sheet separating device. With reference to the image reading device 1, directions of up, down, right, left, front, and rear may be defined with reference to an orientation of the image reading device 1 that is disposed in which it is intended to be used as depicted in FIG. 1. The defined directions are applicable to all the drawings.

<Overall Configuration>

As depicted in FIGS. 1 through 5, the image reading device 1 includes a main body 8, an openable unit 9, an image forming unit 5, a reading unit 3, and a conveying unit 4. The main body 8 has a generally box shape with a relatively lower height. As depicted in FIG. 1, an operation panel 8P, e.g., a touch panel, is disposed at the front of the main body 8.

Figure 4:
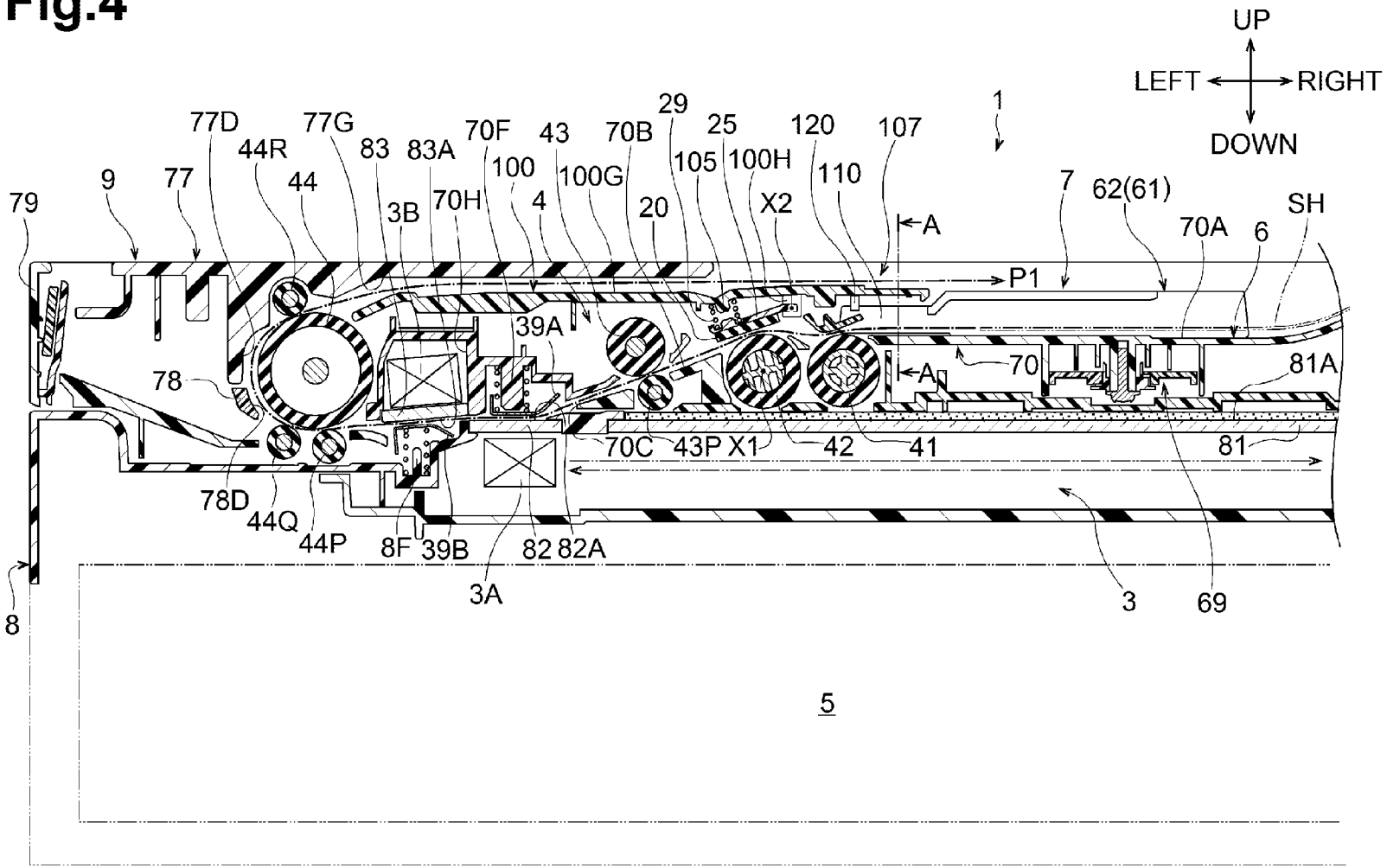
FIG. 4 is a partial sectional view depicting the image reading device in the first illustrative embodiment according to one or more aspects of the disclosure.

As depicted in FIG. 4, the image forming unit 5 is disposed in a lower portion of the main body 8. The image forming unit 5 forms an image onto a sheet using an inkjet recording method or a laser recording method. The reading unit 3 is disposed in an upper portion of the main body 8. The reading unit 3 reads an image from a moving document and a stationary document. The moving document includes a sheet SH. The openable unit 9 includes the conveying unit 4. The conveying unit 4 conveys one or more sheets SH successively along one of a conveying path P1 (refer to FIG. 4) and a conveying path P2 (refer to FIG. 5) at the time of reading an image from each of the one or more sheets SH by the reading unit 3.

As depicted in FIG. 4, the main body 8 includes a first platen glass 81 and a second platen glass 82 at the top of the main body 8. An upper surface of the first platen glass 81 functions as a document support surface 81A. The document support surface 81A supports a stationary document from below at the time of reading an image from the document by the reading unit 3. The stationary document includes a book as well as a sheet, such as a paper sheet and an overhead projector sheet. The second platen glass 82 is disposed to the left of the first platen glass 81 and is elongated in a front-rear direction. An upper surface of the second platen glass 82 functions as a reading surface 82A. At the time of reading an image by the reading unit 3 from a moving sheet SH being conveyed by the conveying unit 4, the reading surface 82A supports and guides the moving sheet SH from below.

As depicted in FIG. 1, the openable unit 9 is supported by a hinge (not depicted) disposed at an upper end of a rear surface of the main body 8 so as to be pivotable about a pivot axis X9 that extends in a right-left direction. As depicted in FIGS. 1 through 5, in a state where the openable unit 9 is closed, the openable unit 9 covers the document support surface 81A from above. In response to pivoting of the openable unit 9 about the pivot axis X9 such that a front end portion of the openable unit 9 moves upward and rearward, the openable unit 9 moves to an open position where the openable unit 9 exposes the document support surface 81A as depicted in FIG. 1 by a double-dotted and dashed line. In a state where the openable unit 9 is located at the open position, a user is allowed to place a document to be read on the document support surface 81A.

As depicted in FIG. 4, the reading unit 3 includes a reading sensor 3A, a scanning mechanism (not depicted), and a reading sensor 3B. The reading sensor 3A is disposed in an upper portion of the main body 8. The reading sensor 3B is disposed within the openable unit 9. The reading sensors 3A and 3B are an example of a reading unit.

The reading sensor 3A is caused to reciprocate in the right-left direction under the document support surface 81A and the reading surface 82A within the main body 8 by the scanning mechanism. The reading sensor 3A is also retained at a specified position, for example, a fixed reading position, under the reading surface 82A. The reading sensor 3B is disposed at a particular position in a common route of the conveying paths P1 and P2 in the openable unit 9. A known image reading sensor, for example, a contact image sensor ("CIS") or a charge-coupled device ("CCD"), may be used for the reading sensors 3A and 3B.

Figure 3:
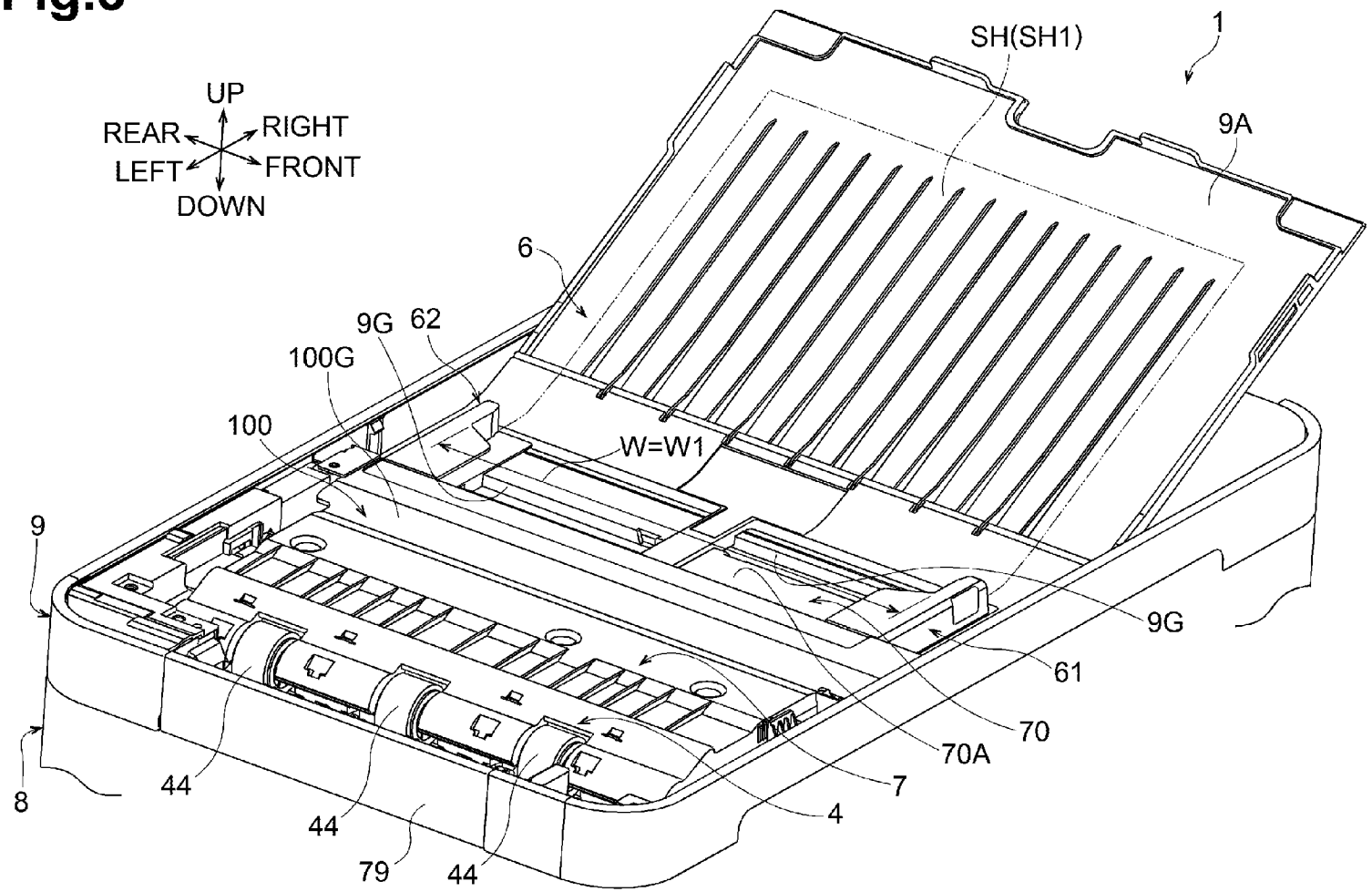
FIG. 3 is a perspective view depicting the support member and the movable guide pair of the image reading device in the first illustrative embodiment according to one or more aspects of the disclosure, from which an exterior cover is removed.
Figure 5:
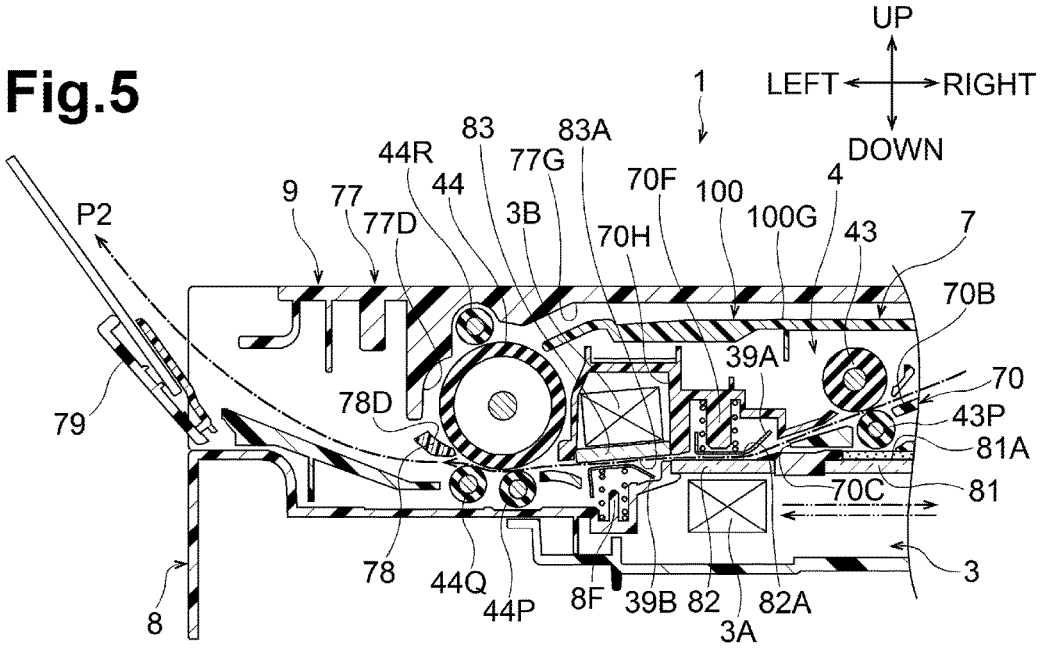
FIG. 5 is a partial sectional view depicting the image reading device in the first illustrative embodiment according to one or more aspects of the disclosure.

As depicted in FIGS. 3, 4, and 5, the image reading device 1 further includes a support member 6, a base member 70, a cover member 100, a movable guide pair including a front movable guide 61 and a rear movable guide 62, and an exterior cover 77. The front movable guide 61 is an example of a first guide and the rear movable guide 62 is an example of a second guide.

Figure 2:
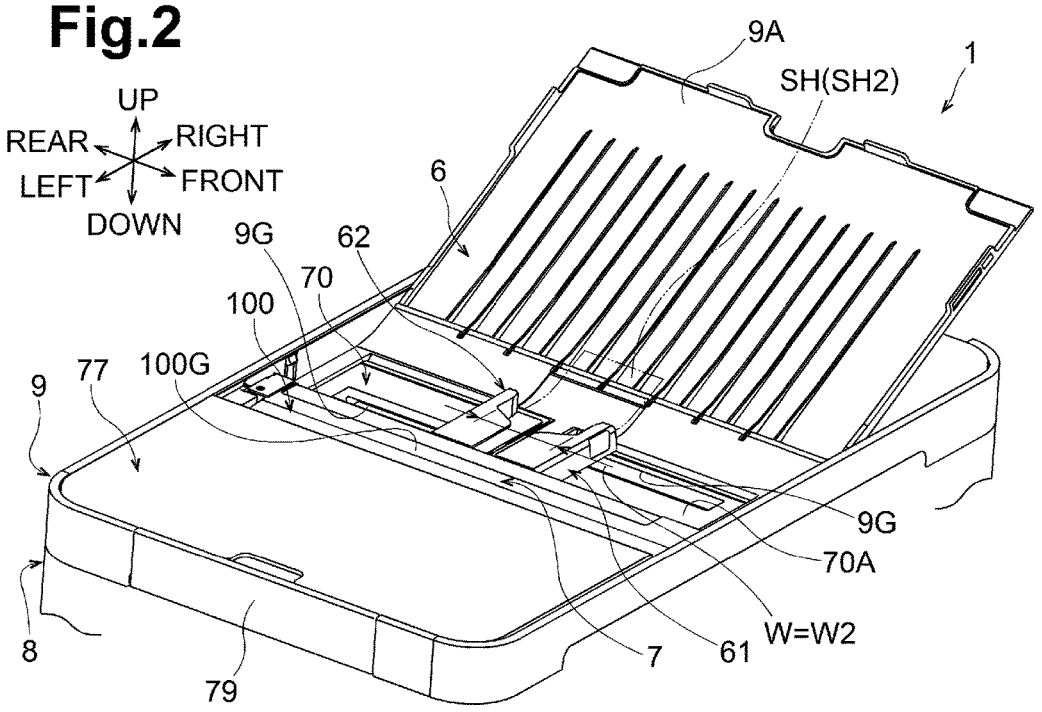
FIG. 2 is a perspective view depicting a support member and a movable guide pair of the image reading device in the first illustrative embodiment according to one or more aspects of the disclosure.

As depicted in FIGS. 1, 2, and 3, the openable unit 9 includes a document rest 9A at a middle portion of the top of the openable unit 9. The openable unit 9 further includes an exterior cover 77 at a left portion of the top of the openable unit 9. The document rest 9A is configured to be opened and closed. When the document rest 9A is closed (refer to FIG. 1), the document rest 9A constitutes a portion of an upper exterior of the openable unit 9 in conjunction with the exterior cover 77. When the document rest 9A is opened (refer to FIGS. 2 and 3), the document rest 9A constitutes a portion of the support member 6. The support member 6 supports one or more sheets SH to be conveyed in a predetermined conveying direction by the conveying unit 4. The sheet SH to be read includes a paper sheet and an overhead projector sheet.

As depicted in FIGS. 2, 3, 4, and 5, the base member 70 constitutes a lower portion of the openable unit 9. The base member 70 has a generally flat plate shape and extends so as to cover the document support surface 81A and the reading surface 82A in a state where the openable unit 9 is closed.

The base member 70 has an upper surface including a support surface 70A. The support surface 70A is contiguous with a left end of the opened document rest 9A and extends substantially horizontally leftward. The support surface 70A supports from below one or more sheets SH placed on the document rest 9A. The support surface 70A also constitutes a portion of the support member 6 in conjunction with the opened document rest 9A.

As depicted in FIGS. 2, 3, and 4, the movable guides 61 and 62 are disposed on the support surface 70A of the base member 70. The movable guides 61 and 62 each include an upright protruding portion and an extended portion. The upright protruding portion protrudes uprightly. The upright protruding portions of the movable guides 61 and 62 face each other while being spaced apart from each other by a distance W in the front-rear direction. The extended portions of the movable guides 61 and 62 extend toward each other from upper ends, respectively, of the upright protruding portions of the movable guides 61 and 62 in the front-rear direction. The front-rear direction in which the movable guides 61 and 62 face each other is an example of a width direction.

As depicted in FIGS. 2 and 3, the support surface 70A of the base member 70 includes a guide rail 9G extending in the front-rear direction. The movable guides 61 and 62 are supported by the base member 70 so as to be slidable in the front-rear direction along the guide rail 9G. As depicted in FIG. 4, a rack and pinion mechanism 69 is disposed on a lower surface of the base member 70. The lower surface of the base member 70 is a surface opposite to the support surface 70A of the base member 70. The movable guides 61 and 62 are connected with each other by the rack and pinion mechanism 69.

The rack and pinion mechanism 69 transmits movement of one of the movable guides 61 and 62 to the other of the movable guides 61 and 62. More specifically, as depicted in FIG. 2, when one of the movable guides 61 and 62 moves in a direction such that the one of the movable guides 61 and 62 approaches the other of the movable guides 61 and 62 with respect to the front-rear direction, the rack and pinion mechanism 69 transmits the approaching movement to the other of the movable guides 61 and 62 to move the other of the movable guides 61 and 62 toward the one of the movable guides 61 and 62 in the front-rear direction. As depicted in FIG. 3, when one of the movable guides 61 and 62 moves in a direction such that the one of the movable guides 61 and 62 recedes from the other of the movable guides 61 and 62 with respect to the front-rear direction, the rack and pinion mechanism 69 transmits the receding movement to the other of the movable guides 61 and 62 to move the other of the movable guides 61 and 62 away from the one of the movable guides 61 and 62 in the front-rear direction. At any positions, a distance between a middle portion of the support surface 70A and the movable guide 61 in the front-rear direction is equal to a distance between the middle portion of the support surface 70A and the movable guide 62 in the front-rear direction.

With this configuration, the movable guides 61 and 62 are moved in respective directions (e.g., frontward and rearward, respectively, or vice versa) such that the distance W therebetween increases or decreases. In other words, the movable guides 61 and 62 are moved relative to each other in the front-rear direction such that the distance W therebetween increases or decreases. Through such a movement, the movable guides 61 and 62 align one or more sheets SH supported by the support member 6 with respect to the center of the support member 6 in the front-rear direction. Sheets SH of various sizes may be available for use.

For aligning one or more sheets SH (e.g., sheets SH1) having a relatively wide width, e.g., a width of an A4-size sheet, with respect to the center of the support member 6 in the front-rear direction, the distance W between the movable guides 61 and 62 is changed to approximately a distance W1 such that the movable guides 61 and 62 are located apart from each other by the distance W1 as depicted in FIG. 3. For aligning one or more sheets SH (e.g., sheets SH2) having a relatively narrow width, e.g., a width of a business card, with respect to the center of the support member 6 in the front-rear direction, the distance W between the movable guides 61 and 62 is changed to approximately a distance W2 such that the movable guides 61 and 62 are located apart from each other by the distance W2 as depicted in FIG. 2. The distance W2 may be shorter than the distance W1. An A4-size sheet may be an example of a sheet SH (e.g., a sheet SH1) having a relatively wide width. The movable guides 61 and 62 are also located apart from each other by about the distance W1 for aligning, for example, one or more letter-size sheets or A3-size sheets. The A3-size sheet is aligned with respect to its shorter sides. A business card may be an example of a sheet SH (e.g., a sheet SH2) having a relatively narrow width. The movable guides 61 and 62 are also located apart from each other by about the distance W2 for aligning, for example, one or more cards of various kinds, postcards, or A6-size sheets.

Figure 6:
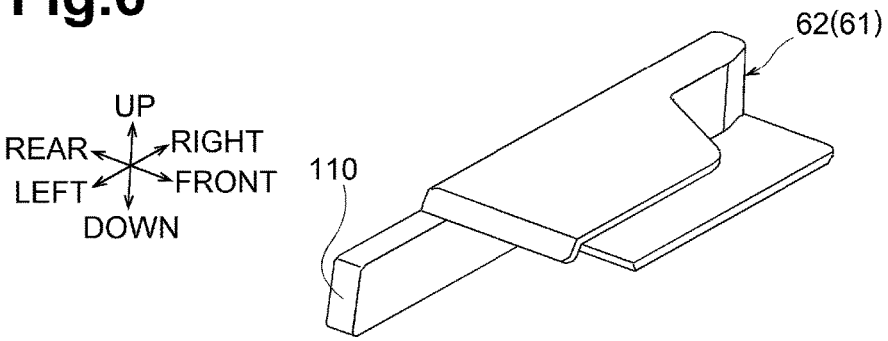
FIG. 6 is perspective view depicting a rear movable guide of the movable guide pair of image reading device in the first illustrative embodiment according to one or more aspects of the disclosure.

In FIGS. 4 and 6, only the rear movable guide 62 is depicted. The rear movable guide 62 includes a rear actuating portion 110 that is integral therewith. The rear actuating portion 110 may be a generally rectangular column portion that protrudes leftward from a left end of the upright protruding portion of the rear movable guide 62. The front movable guide 61 may have a symmetrically opposite configuration to the rear movable guide 62. The front movable guide 61 also includes a front actuating portion 110 that is integral therewith.

Figure 7:
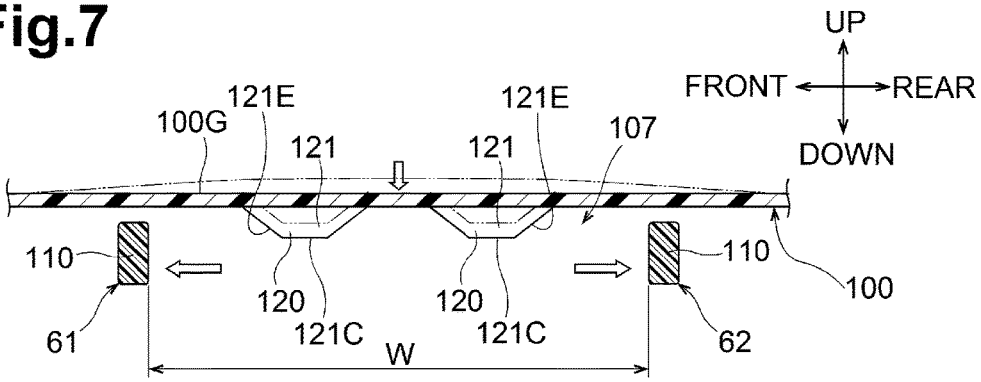
FIG. 7 is a schematic view taken along line A-A of FIG. 4 for explaining a behavior of an engaging mechanism of the image reading device in the first illustrative embodiment according to one or more aspects of the disclosure.

As depicted in FIG. 7, the actuating portion 110 of the front movable guide 61 and the actuating portion 110 of the rear movable guide 62 protrude leftward while being spaced apart from each other in the front-rear direction. The actuating portions 110 of the movable guides 61 and 62 partially constitute an engaging mechanism 107.

As depicted in FIG. 4, the base member 70 includes a pressing-member supporting portion 70F and a casing portion 70H and has an inclined surface 70B and an opening 70C. The inclined surface 70B is disposed to the left of the support surface 70A and is contiguous with the support surface 70A. The inclined surface 70B is inclined downward to the left. The opening 70C is defined in a particular position to the left of the inclined surface 70B. The opening 70C may be a slit having a rectangular shape elongated in the front-rear direction. The pressing-member supporting portion 70F is disposed above the opening 70C while being elongated in the front-rear direction so as to extend across the opening 70C in the front-rear direction. The casing portion 70H is disposed to the left of the pressing-member supporting portion 70F and has a recess upwardly recessed relative to a lower surface of the casing portion 70H.

A pressing member 39A is disposed at a lower portion of the pressing-member supporting portion 70F. The pressing member 39A is supported by the pressing-member supporting portion 70F so as to be movable in the up-down direction. The pressing member 39A faces the reading surface 82A from above while being urged by a compression coil spring.

The casing portion 70H accommodates the reading sensor 3B therein. A third platen glass 83 is disposed below the reading sensor 3B. The third platen glass 83 covers an opening of the casing portion 70H. A lower surface of the third platen glass 83 functions as a reading surface 83A. At the time of reading an image by the reading unit 3 from a moving sheet SH being conveyed by the conveying unit 4, the reading surface 83A guides the moving sheet SH from above.

A pressing-member supporting portion 8F is disposed at the upper surface of the main body 8 and to the left of the second platen glass 82. The pressing-member supporting portion 8F is located below the third platen glass 83 in a state where the openable unit 9 is closed.

A pressing member 39B is disposed above the pressing-member supporting portion 8F. The pressing member 39B is supported by the pressing-member supporting portion 8F so as to be movable in the up-down direction. The pressing member 39B faces the reading surface 83A from below while being urged by a compression coil spring.

As depicted in FIGS. 4 and 5, the base member 70 supports a path switching member 78 such that the path switching member 78 is movable between a first position (e.g., a position of the path switching member 78 depicted in FIG. 4) and a second position (e.g., a position of the path switching member 78 depicted in FIG. 5). The path switching member 78 is disposed further to the left than the casing portion 70H. The path switching member 78 has a surface facing the right which functions as a lower curved guide surface 78D. As depicted in FIG. 4, the lower curved guide surface 78D faces a peripheral surface of a discharge roller 44 constituting the conveying unit 4 while being spaced apart from the peripheral surface of the discharge roller 44 at a predetermined interval. The lower curved guide surface 78D is curvedly inclined upward to the left.

The path switching member 78 moves from the first position (refer to FIG. 4) to the second position (e.g., refer to FIG. 5) in response to opening of a left side cover 79 of the openable unit 9 from a closed position (e.g., a position of the left side cover 79 depicted in FIG. 4) to an open position (e.g., a position of the left side cover 79 depicted in FIG. 5). When the path switching member 78 is located the second position (refer to FIG. 5), a lower end portion of the lower curved guide surface 78D is located at a position further to the right than the lower end portion of the lower curved guide surface 78D that is located at the first position (refer to FIG. 4), while being adjacent to but not in contact with the peripheral surface of the discharge roller 44 constituting the conveying unit 4.

As depicted in FIGS. 3, 4, and 5, the cover member 100 is disposed over a left portion of the support surface 70A, the inclined surface 70B, the opening 70C, the pressing-member supporting portion 70F, and the casing portion 70H while extending both in the front-rear direction and in the right-left direction. The cover member 100 may be an injection molded member made of thermoplastic resin. The cover member 100 is attached to an upper portion of the base member 70 such that a front end and a rear end of the cover member 100 are fixed to the base member 70 while the cover member 100 lying over the left portion of the support surface 70A, the inclined surface 70B, the opening 70C, the pressing-member supporting portion 70F, and the casing portion 70H in the front-rear direction. The cover member 100 has an upper surface, which extends in a substantially horizontal direction and serves as a guide surface 100G.

The guide surface 100G is adjacent to the extended portions of the movable guides 61 and 62 from the left. The extended portions of the movable guides 61 and 62 and the guide surface 100G constitute a discharge portion 7. The discharge portion 7 is disposed above the support member 6. After a sheet SH having an image is read using the reading sensors 3A and 3B while the conveying unit 4 conveys the sheet SH, the sheet SH is discharged onto the discharge portion 7.

As depicted in FIGS. 4 and 5, the exterior cover 77 covers a portion of the guide surface 100G and the discharge roller 44 constituting the conveying unit 4 from above. The exterior cover 77 has a lower surface that includes a guide surface 77G and an upper curved guide surface 77D. The guide surface 77G of the exterior cover 77 faces the guide surface 100G of the cover member 100 from above. The upper curved guide surface 77D is provided in a particular area of the exterior cover 77 so as to face the discharge roller 44. The upper curved guide surface 77D is contiguous to the lower curved guide surface 78D and inclined curvedly upward to the right when the path switching member 78 is located at the first position (refer to FIG. 4).

The exterior cover 77 supports a pinch roller 44R such that the pinch roller 44R is rotatable. The pinch roller 44R constitutes the conveying unit 4.

As depicted in FIG. 4, the conveying path P1 is defined by the base member 70, the cover member 100, the path switching member 78, and the exterior cover 77 when the left side cover 79 of the openable unit 9 is located at the closed position.

The conveying path P1 extends from the support surface 70A. The conveying path P1 then extends inclinatorily downward to the left along the inclined surface 70B and further extends leftward so as to pass above the reading surface 82A of the second platen glass 82. A lower surface of the pressing member 39A defines a portion of the conveying path P1 while facing the reading surface 82A from above.

The conveying path P1 further extends so as to pass below the reading surface 83A of the third platen glass 83. An upper surface of the pressing member 39B defines a portion of the conveying path P1 while facing the reading surface 83A from below.

The conveying path P1 further extends along the lower curved guide surface 78D and the upper curved guide surface 77D so as to make a U-turn upward for changing a conveying direction of a sheet SH from the leftward direction to the rightward direction.

The conveying path P1 further extends rightward along the guide surface 100G of the cover member 100 to a position above the extended portions of the movable guides 61 and 62. The guide surface 77G of the exterior cover 77 faces across the conveying path P1 from the guide surface 100G of the cover member 100 while defining a portion of the conveying path P1 from above. The guide surface 77G of the exterior cover 77 guides a moving sheet SH onto the extended portions of the movable guides 61 and 62 in conjunction with the guide surface 100G of the cover member 100 while being in contact with the moving sheet SH.

As described above, the conveying path P1 guides a sheet SH from the support member 6 to the respective positions where the reading sensors 3A and 3B are disposed, and further guides the sheet SH to the discharge portion 7. The conveying path P1 is used for conveying a relatively thin sheet SH having a relatively large size, for example, A4 size plain paper or letter size plain paper.

As depicted in FIG. 5, when the left side cover 79 of the openable unit 9 is located at the open position, the conveying path P2 is defined by the base member 70, a lower surface of the path switching member 78, and the left side cover 79. The conveying path P2 and the conveying path P1 have a common route from the support member 6 to a position immediately in front of the path switching member 78. When the path switching member 78 is located at the second position as depicted in FIG. 5, the path switching member 78 defines a portion of the conveying path P2 and prevents a sheet SH from being conveyed upward along the conveying path P1. That is, the conveying path P2 guides a moving sheet SH using the path switching member 78 located at the second position such that the sheet SH is conveyed leftward.

As described above, the conveying path P2 guides a sheet SH from the support member 6 to the respective positions where the reading sensors 3A and 3B are disposed, and further guides the sheet SH onto an upwardly facing surface of the opened left side cover 79. The conveying path P2 is used for conveying a sheet SH having a relatively small size, for example, a business card, or a relatively large size sheet SH having a relatively higher stiffness, for example, thick paper.

As depicted in FIG. 4, the conveying unit 4 includes a feed roller 41, a separation roller 42, a separation pad 20, a holder 25, a base portion 105, and a compression coil spring 29. Each of the separation pad 20 and the holder 25 is an example of a separation member. The compression coil spring 29 is an example of an urging member.

The feed roller 41 and the separation roller 42 are rotatably supported by the base member 70. Upper portions of the feed roller 41 and the separation roller 42 are exposed at a left portion of the support surface 70A of the base member 70. The separation roller 42 is disposed downstream of the feed roller 41 in the common route of the conveying paths P1 and P2, that is, the separation roller 42 is disposed to the left of the feed roller 41. The separation roller 42 is rotatable about a first axis X1 extending parallel to the front-rear direction. The feed roller 41 and the separation roller 42 are driven by a drive source (not depicted) to rotate in synchronization with each other. The feed roller 41 conveys a sheet SH supported by the support member 6 in a downstream direction, e.g., in the leftward direction, along the conveying direction. The separation roller 42 conveys the sheet SH supported by the support member 6 in the leftward direction in conjunction with the feed roller 41.

Figure 8:
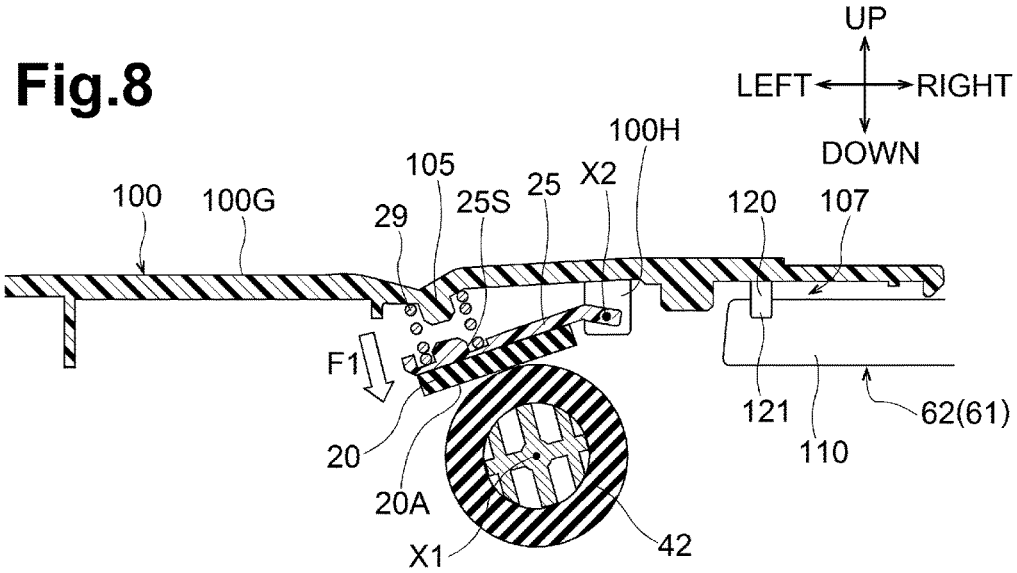
FIG. 8 is a partial sectional view of the image reading device including a separation roller, a separation pad, a holder, a compression coil spring, a base portion, and the engaging mechanism in the first illustrative embodiment according to one or more aspects of the disclosure.

As depicted in FIG. 8, the separation pad 20 may be a small pa d of friction material made of, for example, rubber, elastomer, or sponge, and have a generally rectangular shape. The separation pad 20 has a lower surface facing the separation roller 42. The lower surface of the separation pad 20 includes a contact surface 20A. The contact surface 20A is capable of applying a frictional force to a sheet SH fed by the feed roller 41 in contact with the sheet SH from above.

The holder 25 has a generally plate shape. The holder 25 may be made of, for example, resin. The cover member 100 includes a holder retaining portion 100H that is integral with the lower surface of the cover member 100. A right end portion of the holder 25 is supported by the holder retaining portion 100H such that the holder 25 is pivotable about a second axis X2 extending in parallel to the first axis X1. The second axis X2 is higher and further to the right than the first axis X1 while extending in the front-rear direction. The holder 25 is disposed above the separation roller 42 and extends in a direction away from the second axis X2 (e.g., in the leftward direction).

The separation pad 20 has an upper surface opposite to the contact surface 20A (e.g., the lower surface). The separation pad 20 faces the separation roller 42 from above. The upper surface of the separation pad 20 is attached to a left end portion of a lower surface of the holder 25. In response to pivoting of the holder 25 about the second axis X2, the separation pad 20 held by the holder 25 moves toward and away from the separation roller 42. The holder 25 includes a spring retaining portion 25S at a left end portion of an upper surface thereof. The spring retaining portion 25S may be an annular groove.

The base portion 105 is integral with the lower surface of the cover member 100. The base portion 105 is disposed further to the left than the holder retaining portion 100H. The base portion 105 protrudes downward from the lower surface of the cover member 100. The base portion 105 has a generally column shape.

While the compression coil spring 29 is elastically deformed, a lower end of the compression coil spring 29 is retained by the spring retaining portion 25S of the holder 25 and an upper end of the compression coil spring 29 is retained by the base portion 105. That is, the lower end of the compression coil spring 29 is located closer to the separation pad 20 than the upper end of the compression coil spring 29. The compression coil spring 29 exerts an urging force F1 for urging the separation pad 20 toward the separation roller 42. The magnitude of the urging force F1 of the compression coil spring 29 may change in accordance with change in compression degree of the compression coil spring 29 caused in response to a behavior of the engaging mechanism 107 as described in FIGS. 7, 8, 9, and 10.

When multiple sheets SH are fed by the feed roller 41 at one time, the separation pad 20 separates the multiple sheets SH into a single sheet in conjunction with the separation roller 42. More specifically, the separation pad 20 urged by the urging force F1 of the compression coil spring 29 is pressed against the separation roller 42, whereby a braking force is generated between the separation roller 42 and the separation pad 20 and the generated braking force thus acts on the sheets SH. Therefore, when multiple sheets SH are about to be conveyed by the separation roller 42 at one time, such a braking force acts on one or more sheets SH other than the sheet SH that is in contact with the separation roller 42. Thus, only a single sheet SH is separated from the other sheets SH.

As depicted in FIG. 4, the conveying unit 4 further includes a conveying roller 43, the discharge roller 44, and pinch rollers 43P, 44P, 44Q, and 44R.

The conveying roller 43 is rotatably supported by the cover member 100 while facing the inclined surface 70B from above. The pinch roller 43P is rotatably supported by the base member 70 while an upper portion of the pinch roller 43P is exposed at the inclined surface 70B. The pinch roller 43P is pressed toward the conveying roller 43.

The discharge roller 44 is disposed further to the right than the lower curved guide surface 78D and the upper curved guide surface 77D while being rotatably supported by the base member 70. The discharge roller 44 is disposed diagonally above and to the right of the lower curved guide surface 78D of the path switching member 78. The peripheral surface of the discharge roller 44 faces, across a curved portion of the conveying path P1, the lower curved guide surface 78D of the path switching member 78. The discharge roller 44 is disposed diagonally below and to the right of the upper curved guide surface 77D of the exterior cover 77. The peripheral surface of the discharge roller 44 faces, across the curved portion of the conveying path P1, the upper curved guide surface 77D of the exterior cover 77.

The pinch rollers 44P and 44Q are disposed lower than a lower portion of the peripheral surface of the discharge roller 44 and are rotatably supported by the base member 70. The pinch rollers 44P and 44Q are pressed toward the discharge roller 44. The pinch roller 44R is rotatably supported by the exterior cover 77 while being pressed toward the discharge roller 44R.

The conveying roller 43 and the pinch roller 43P convey, toward the opening 70C and the discharge roller 44, a sheet SH fed into the conveying path P1 by the feed roller 41 and the separation roller 42. Thus, the sheet SH passes between the reading surface 82A of the second platen glass 82 and the lower surface of the pressing member 39A, that is, the sheet SH passes above the reading sensor 3A. Then, the sheet SH passes between the reading surface 83A of the third platen glass 83 and the upper surface of the pressing member 39B, that is, the sheet SH passes under the reading sensor 3B.

As depicted in FIG. 4, in a state where the left side cover 79 of the openable unit 9 is located at the closed position, the discharge roller 44, and the pinch rollers 44P, 44Q, and 44R convey a sheet SH, which has passed above the reading sensor 3A and below the reading sensor 3B, along the curved portion of the conveying path P1 such that the sheet SH makes a U-turn upward. At the time of conveying the sheet SH along the curved portion of the conveying path P1, the lower curved guide surface 78D and the upper curved guide surface 77D guide the sheet SH while being in contact with the sheet SH from the left to make the sheet SH warped. Then, the discharge roller 44 and the pinch roller 44R further convey the sheet SH rightward to discharge the sheet SH to the discharge portion 7. Thus, the discharged sheet SH is placed onto the extended portions of the movable guides 61 and 62 and the guide surface 100G functioning as the discharge portion 7. A plurality of discharged sheets SH may be stacked onto the extended portions of the movable guides 61 and 62 and the guide surface 100G. That is, the guide surface 100G guides a moving sheet SH and also supports one or more discharged sheets SH thereon.

As depicted in FIG. 5, in a state where the left side cover 79 of the openable unit 9 is located at the open position and the path switching member 78 prohibits a sheet SH from moving upward along the conveying path P1, the discharge roller 44 and the pinch rollers 44P and 44Q convey leftward a sheet SH, which has passed above the reading sensor 3A and below the reading sensor 3B, along the conveying path P2. Thus, the sheet SH is discharged onto the upwardly facing surface of the opened left side cover 79.

<Image Reading Operation>

For reading an image from a stationary document supported by the document support surface 81A, in the image reading device 1, the scanning mechanism (not depicted) operates in the reading unit 3 to move (e.g., reciprocate) the reading sensor 3A in the right-left direction between a position below a left end of the document support surface 81A and a position below a right end of the document support surface 81A. By doing so, the reading sensor 3A reads an image from the stationary document supported by the document support surface 81A. Thereafter, the scanning mechanism moves the reading sensor 3A from the right end to the left end in the reading unit 3 to return the reading sensor 3A to the original position.

In the reading unit 3, for reading an image from each of one or more sheets SH supported by the support member 6, including the document rest 9A and the support surface 70A, the scanning mechanism operates in the reading unit 3 to move the reading sensor 3A to the fixed reading position under the reading surface 82A and stops the reading sensor 3A at the fixed reading position. As the conveying unit 4 conveys, one by one, one or more sheets SH placed extending over the document rest 9A and the support surface 70A, along one of the conveying path P1 (refer to FIG. 4) and the conveying path P2 (refer to FIG. 5), the sheet SH passes above the reading sensor 3A located at the fixed reading position while being in contact with the reading surface 82A. The sheet SH further passes below the reading sensor 3B while being in contact with the reading surface 83A. Thus, the reading sensors 3A and 3B read images from respective sides of the moving sheet SH. The conveying unit 4 further conveys the sheet SH, from which images have been read, and discharges the sheet SH to one of the discharge portion 7 and the opened left side cover 79.

<Engaging Mechanism>

In the first illustrative embodiment, as depicted in FIGS. 4, 6, 7, 8, 9, and 10, in the image reading device 1, the engaging mechanism 107 is disposed between the base portion 105 and the movable guide pair including the movable guides 61 and 62 in the right-left direction. The engaging mechanism 107 includes the front and rear actuating portions 110 and front and rear receiving portions 120.

As described above, the front and rear actuating portions 110 are integral with the front and rear movable guides 61 and 62, respectively.

As depicted in FIGS. 4, 7, 8, 9, and 10, the receiving portions 120 are integral with the lower surface of the cover member 100. The front receiving portion 120 and the rear receiving portion 120 are disposed at respective different positions but have the same or similar configuration. The receiving portions 120 each include a rib-like protrusion 121 that protrudes downward and extends in the front-rear direction. The direction that the protrusions 121 protrude (e.g., the downward direction) is an example of a third direction. The protrusions 121 each include front and rear ends in the front-rear direction and a middle portion 121C between the front and rear ends in the front-rear direction. The front end of the front protrusion 121 has an inclined surface 121E that is inclined relative to the downward direction, and a portion of the inclined surface 121E closer to the middle portion 121C of the front protrusion 121 protrudes further in the downward direction. The rear end of the rear protrusion 121 also includes an inclined surface 121E that is inclined symmetrically with the inclined surface 121E of the front end of the front protrusion 121.

Figure 9:
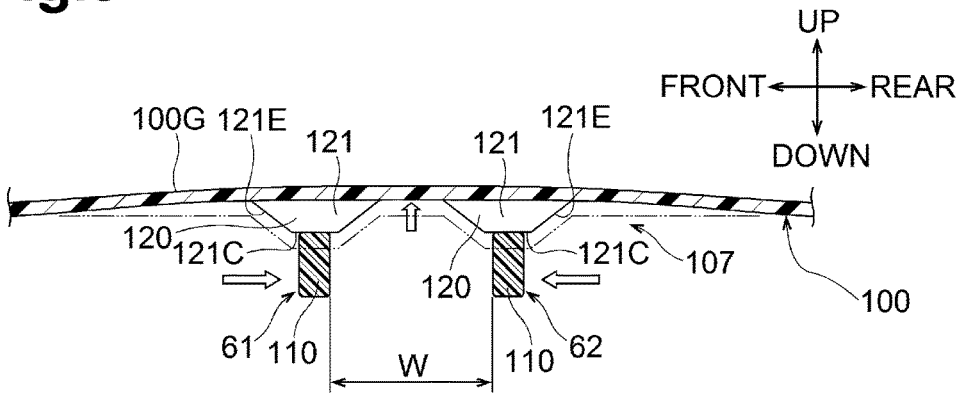
FIG. 9 is a schematic view taken along line A-A of FIG. 4 for explaining a behavior of the engaging mechanism of the image reading device in the first illustrative embodiment according to one or more aspects of the disclosure.
Figure 10:
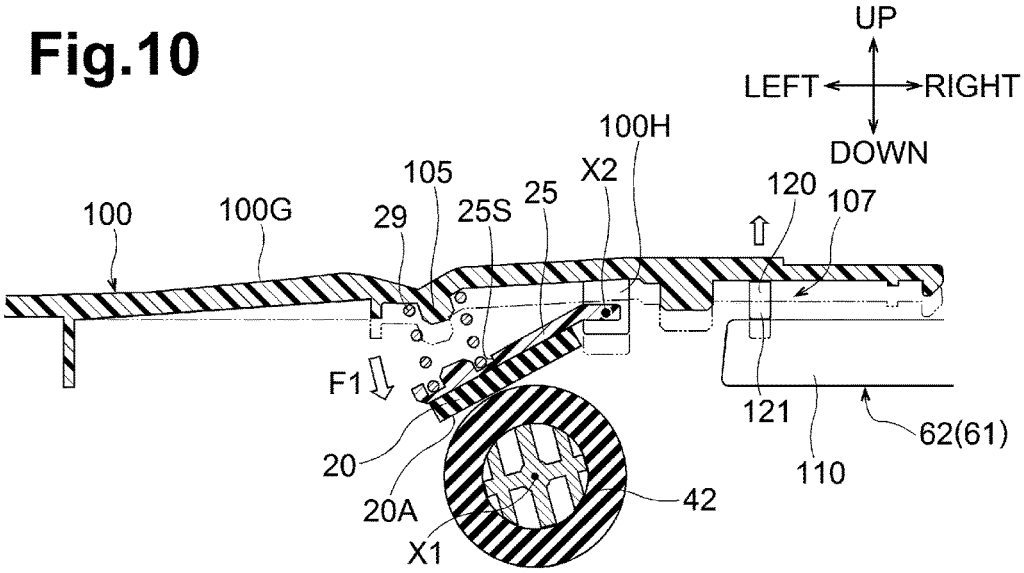
FIG. 10 is a partial sectional view depicting the separation roller, the separation pad, the holder, the compression coil spring, the base portion, and the engaging mechanism in the first illustrative embodiment according to one or more aspects of the disclosure.

The cover member 100 integrally including the receiving portions 120 may be made of resin. Therefore, the cover member 100 has flexibility. The cover member 100 may have a generally plate-like shape and is disposed on the same side as the separation pad 20 with respect to the separation roller 42. The cover member 100 extends facing the separation roller 42 from above. The front end and the rear end of the cover member 100 are fixed to the base member 70 while a right end portion of the cover member 100 is free. Thus, the right end portion of the cover member 100 is capable of warping upward further away from the separation roller 42 as depicted in FIGS. 9 and 10. The cover member 100 is an example of a platelike member.

In FIGS. 7 and 8, the movable guides 61 and 62 are located apart from each other by approximately the distance W1 after the movable guides 61 and 62 are moved in respective directions such that the distance W therebetween increases. While the movable guides 61 and 62 are moved, the front and rear actuating portions 110 are also moved integral with the movable guides 61 and 62, respectively. In the state depicted in FIGS. 7 and 8, the front actuating portion 110 is located further to the front than the front receiving portion 120 and is spaced apart from the front receiving portion 120, and the rear actuating portion 110 is located further to the rear than the rear receiving portion 120 and is spaced apart from the rear receiving portion 120. Lower ends of the middle portions 121C and portions of the inclined surfaces 121E of the receiving portions 120 are located lower than upper ends of the actuating portions 110.

In FIGS. 9 and 10, the movable guides 61 and 62 are located apart from each other by the distance W2 after the movable guides 61 and 62 are moved in respective directions such that the distance W therebetween decreases. While the movable guides 61 and 62 are moved, the front and rear actuating portions 110 are also moved integrally with the movable guides 61 and 62, respectively. In this state, the front actuating portion 110 is in contact with the front receiving portion 120 to press the front receiving portion 120 upward and the rear actuating portion 110 is in contact with the rear receiving portion 120 to press the rear receiving portion 120 upward. While the movable guides 61 and 62 are moved in respective directions such that the distance W therebetween decreases, the actuating portions 110 slide along the inclined surfaces 121E of the protrusions 121, respectively. Therefore, contact resistance caused between the actuating portion 110 and the receiving portion 120 may be reduced.

The actuating portions 110 press the respective receiving portions 120 upward to cause an upward warping in the right end portion of the cover member 100, thereby increasing a gap between the cover member 100 and the separation roller 42. In response to this, the base portion 105 moves upward and a gap between the base portion 105 and the separation roller 42 increases. Thus, the compression coil spring 29 whose upper end is fixed to the base portion 105 becomes less compressed. Accordingly, the urging force F1 of the compression coil spring 29 is reduced. The magnitude of the urging force F1 under this condition corresponds to a first level. The direction in which the base portion 105 is warped (e.g., the upward direction) is an example of a first direction. In response to the upward warping in the right end portion of the cover member 100, the holder retaining portion 100H also moves upward together with the base portion 105 and thus a gap between the holder retaining portion 100H and the separation roller 42 increases. Thus, a contacting posture of the separation pad 20 relative to the separation roller 42 is also changed.

In contrast, in response to movement of the movable guides 61 and 62 in the respective directions such that the distance W therebetween increases to be the distance W1, the actuating portions 110 move away from the respective receiving portions 120 to disengage therefrom as depicted in FIGS. 7 and 8. Thus, the actuating portions 110 do not press the respective receiving portions 120 upward, whereby the cover member 100 becomes flat such that the cover member 100 returns to its original position where the cover member 100 is located closer to the separation roller 42 than the cover member 100 that is warped. In response to the restoration of the cover member 100, the base portion 105 moves downward toward the separation roller 42. Thus, the compression coil spring 29 returns to the original compressed state, that is, the compression coil spring 29 becomes more compressed as compared with a case where the distance W is approximately equal to the distance W2. Accordingly, the urging force F1 of the compression coil spring 29 is increased. The magnitude of the urging force F1 under this condition corresponds to a second level that is greater than the first level. The direction in which the base portion 105 moves in response to the restoration of the cover member 100 (e.g., the downward direction) is an example of a second direction.

In short, in response to the movable guides 61 and 62 decreasing the distance W, the engaging mechanism 107 reduces the urging force F1 of the compression coil spring 29 by moving the base portion 105 upward and, in response to the movable guides 61 and 62 increasing the distance W, the engaging mechanism 107 increases the urging force F1 of the compression coil spring 29 by moving the base portion 105 downward.

<Effects>

In the image reading device 1 according to the first illustrative embodiment, as depicted in FIGS. 9 and 10, the engaging mechanism 107 moves the base portion 105 upward when the actuating portions 110 press the respective receiving portions 120 upward in response to the movement of the movable guides 61 and 62 in the respective directions such that the distance W therebetween decreases, that is, in response to alignment of one or more sheets SH having a relatively narrow width, with respect to a width direction of the support member 6, using the movable guides 61 and 62. Thus, the compression coil spring 29 becomes less compressed, whereby the magnitude of the urging force F1 exerted by the compression coil spring 29 may become weaker, and thus, the pressing load applied between the separation roller 42 and the separation pad 20 may become smaller. In this case, a braking force that acts on sheets SH having a relatively narrow width (e.g., sheets SH2 depicted in FIG. 2) at the time of separating and conveying the sheets SH is weaker than a braking force that acts on sheets SH having a relatively wide width (e.g., sheets SH1 depicted in FIG. 3) at the time of separating and conveying the sheets SH. Accordingly, at the time of separating and conveying the sheets SH having a relatively narrow width (e.g., the sheets SH2), a smaller pressing load appropriate for the sheets SH (e.g., the sheets SH2) having a narrow width may be applied between the separation roller 42 and the separation pad 20, whereby wear of the separation roller 42 and the separating pad 20 may be reduced or prevented.

The moves the base portion 105 downward when the actuating portions 110 disengage from the respective receiving portions 120 so as not to press the receiving portions 120 upward in response to the movement of the movable guides 61 and 62 in the respective directions such that the distance W therebetween increases, that is, in response to alignment of one or more sheets SH having a relatively wide width (e.g., one or more sheets SH1) using the movable guides 61 and 62. Thus, as compared with a case where the movable guides 61 and 62 move in the respective directions such that the distance W therebetween decreases, the compression coil spring 29 becomes more compressed. Therefore, the urging force F1 exerted by the compression coil spring 29 becomes greater and the pressing load applied between the separation roller 42 and the separation pad 20 is increased. By doing so, a braking force that acts on sheets SH having a relatively wide width (e.g., sheets SH1) might not become too weak. Thus, one or more sheets SH other than the sheet SH that is in contact with the separation roller 42 might not slip off the separation pad 20, thereby hardly causing multiple sheet feeding.

Therefore, in the image reading device 1 according to the first illustrative embodiment, the separation performance may be maintained regardless of the size (e.g., the width) of the sheets SH while the wear of the parts, e.g., the separation pad 20, may be reduced.

In the image reading device 1 according to the first illustrative embodiment, the flexibility of the resin cover member 100 is used and the actuating portions 110 integrally provided with the respective movable guides 61 and 62 and the receiving portions 120 integrally formed with the cover member 100 are also used. Further, the compression coil spring 29 may be low in cost. Thus, in the image reading device 1, the up-down movement of the base portion 105 may be achieved with a relatively simple configuration, whereby a manufacturing cost may be lowered.

In the image reading device 1 according to the first illustrative embodiment, as depicted in FIGS. 7 and 9, the front end of the front protrusion 121 constituting the front receiving portion 120 includes the inclined surface 121E that is inclined relative to the downward direction and toward the lower end of the middle portion 121C of the front protrusion 121 in the front-rear direction. The rear end of the rear protrusion 121 constituting the rear receiving portion 120 includes the inclined surface 121E that is inclined relative to the downward direction and toward the lower end of the middle portion 121C of the rear protrusion 121 in the front-rear direction. With this configuration, in the image reading device 1, the inclined surfaces may reduce a resistance caused at the time of contacting the actuating portions 110 with the respective receiving portions 120, whereby the actuating portions 110 may smoothly move to the respective positions where the actuating portions 110 press the respective receiving portions 120 upward.

In the image reading device 1 according to the first illustrative embodiment, the lower end of the compression coil spring 29 is retained by the holder 25 and the upper end of the compression coil spring 29 is retained by the base portion 105. Therefore, the degree of compression of the compression coil spring 29 may be changed appropriately by the movement of the base portion 105 in the up-down direction. Further, the separation pad 20 is reinforced with the holder 25. Therefore, when the degree of compression of the compression coil spring 29 is changed, the contact surface 20A of the separation pad 20 is less likely deformed accordingly. In particular, in the image reading device 1, in response to the upward movement of the base portion 105, the holder retaining portion 100H and the second axis X2 also move upward further away from the separation roller 42. Thus, the contacting posture of the separation pad 20 relative to the separation roller 42 is changed. Accordingly, in the image reading device 1, the separation performance of the separation pad 20 may be changed by combination of the degree of compression of the compression coil spring 29 and the contacting posture of the separation pad 20 relative to the separation roller 42.

In the image reading device 1 according to the first illustrative embodiment, one or more sheets SH are separated into a single sheet SH smoothly and conveyed by the separation roller 42 and the separation pad 20. Then, the reading sensors 3A and 3B read one or more images from the single sheet SH being conveyed. Thus, stable reading quality may be ensured.

Second Illustrative Embodiment

Figure 11:
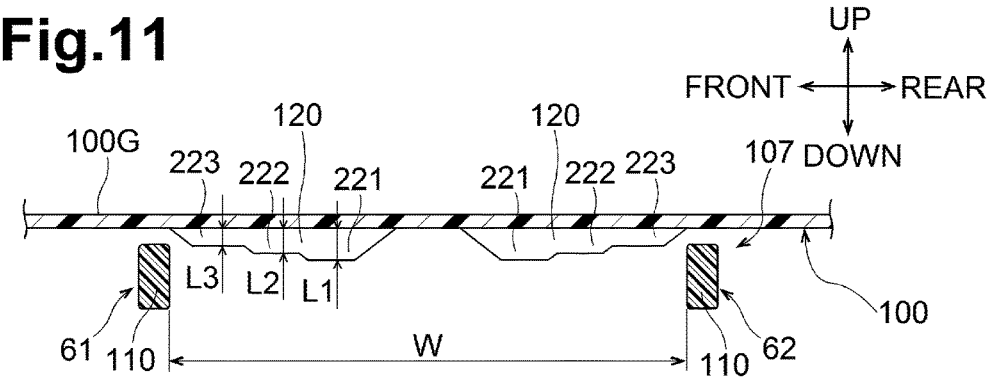
FIG. 11 is a schematic view taken along line A-A of FIG. 4 for explaining a behavior of an engaging mechanism of an image reading device in a second illustrative embodiment according to one or more aspects of the disclosure.

In the image reading device 1 according to the first illustrative embodiment, the receiving portions 120 each include a single protrusion 121. In a second illustrative embodiment, for example, in an image reading device, as depicted in FIG. 11, receiving portions 120 each include a first protruding portion 221, a second protruding portion 222, and a third protruding portion 222. An explanation will be given mainly for the parts different from the first illustrative embodiment, and an explanation will be omitted for the common parts by assigning the same reference numerals thereto.

Protruding lengths of the first protruding portion 221, the second protruding portion 222, and the third protruding portion 222 are different from each other. The protruding length L1 of the first protruding portion 221 is greater than the protruding length L2 of the second protruding portion 222. The protruding length L2 of the second protruding portion 222 is greater than the protruding length L3 of the third protruding portion 222.

The image reading device according to the second illustrative embodiment may provide the same effect as the effect that the image reading device 1 according to the first illustrative embodiment provides. In particular, in the image reading device according to the second illustrative embodiment, each of the actuating portions 110 comes into contact with one of the first protruding portion 221, the second protruding portion 222, and the third protruding portion 222 of a corresponding one of the receiving portions 120. Thus, the magnitude of the urging force F1 of the compression coil spring 29 may be changed step by step. Therefore, the protruding lengths of the first protruding portion 221, the second protruding portion 222, and the third protruding portion 222 are determined respectively appropriate for the various sizes of sheets SH to be supported by the support member 6. Accordingly, the degree of compression of the compression coil spring 29 may be changed appropriately for the size of one or more sheets SH supported by the support member 6, whereby further stable separation performance may be ensured.

Third Illustrative Embodiment

Figure 12:
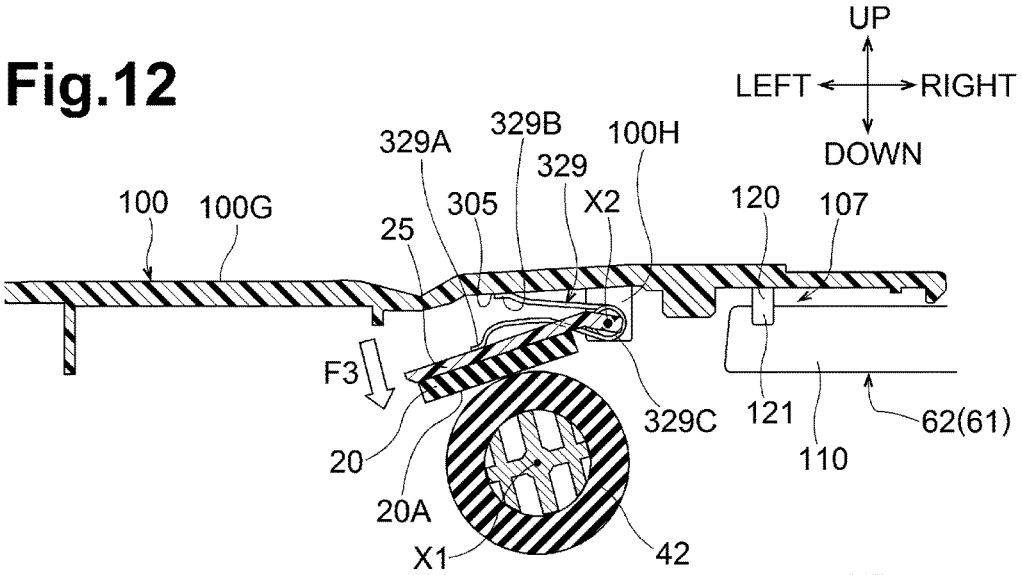
FIG. 12 is a partial sectional view depicting a separation roller, a separation pad, a holder, a torsion coil spring, a base portion, and an engaging mechanism of the image reading device in a third illustrative embodiment according to one or more aspects of the disclosure.
Figure 13:
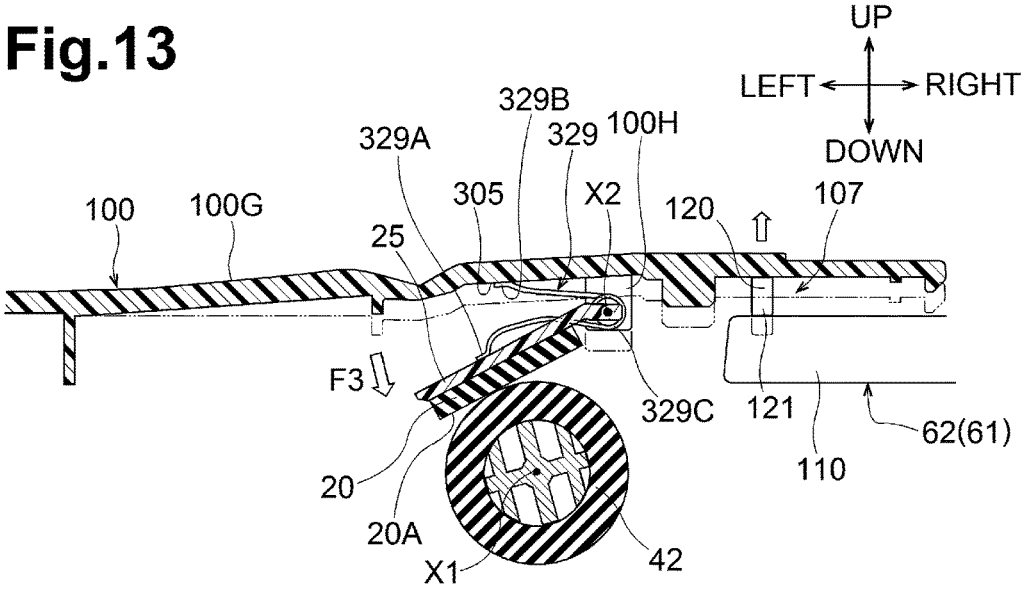
FIG. 13 is a partial sectional view depicting the separation roller, the separation pad, the holder, the torsion coil spring, the base portion, and the engaging mechanism of the image reading device in the third illustrative embodiment according to one or more aspects of the disclosure.

In an image reading device of a third illustrative embodiment, as depicted in FIGS. 12 and 13, a torsion coil spring 329 is used instead of the compression coil spring 29. The torsion coil spring 329 is another example of the urging member. Hereinafter, an explanation will be given mainly for the parts different from the first illustrative embodiment, and an explanation will be omitted for the common parts by assigning the same reference numerals thereto.

In the image reading device of the third illustrative embodiment, the torsion coil spring 329 includes a coil portion 329C, a first end portion 329A, and a second end portion 329B. The first end portion 329A extends in a first direction from the coil portion 329C and the second end portion 329B extends in a second direction from the coil portion 329C.

In the torsion coil spring 329, the coil portion 329C has an axis that is coaxial with the second axis X2, and the coil portion 329C is retained by a holder retaining portion 100H. The first end portion 329A extends from the coil portion 329C in the first direction away from the second axis X2 (e.g., in a leftward direction). The first end portion 329A is retained by a left end portion of the upper surface of the holder 25. The second end portion 329B is disposed above the first end portion 329A and extends from the coil portion 329C in the second direction away from the second axis X2 (e.g., in the leftward direction). The second end portion 329B is retained by the lower surface of the cover member 100. The first end portion 329A and the second end portion 329B of the torsion coil spring 329 may be retained such that the first end portion 329A and the second end portion 329B of the torsion coil spring 329 may be fixed in respective positions by its own elastic deformation.

A portion of the lower surface of the cover member 100 that retains the second end portion 329B of the torsion coil spring 329 may be a base portion 305.

The torsion coil spring 329 exerts an urging force F3 that urges the separation pad 20 toward the separation roller 42. The magnitude of the urging force F3 changes in response to the change in the degree of compression of the torsion coil spring 329 that is caused due to an up-down movement of the base portion 305 when the actuating portions 110 and the receiving portions 120 constituting the engaging mechanism 107 behave as depicted in FIGS. 12 and 13.

The image reading device according to the third illustrative embodiment may provide the same effect as the effect that the image reading device 1 according to the first illustrative embodiment provides.

Fourth Illustrative Embodiment

Figure 14:
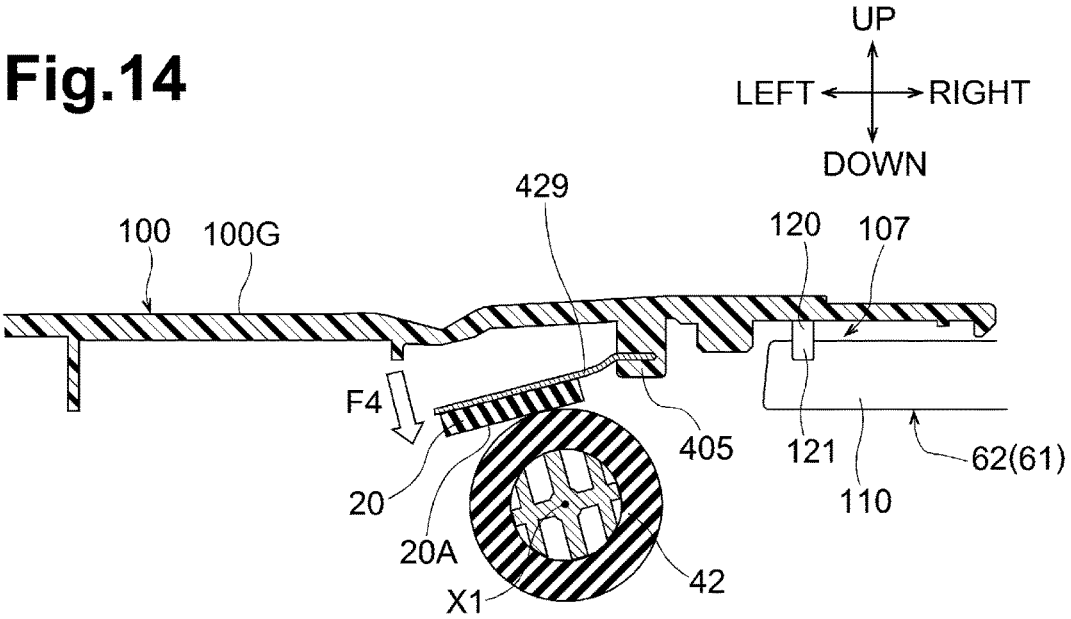
FIG. 14 is a partial sectional view depicting a separation roller, a separation pad, a leaf spring, a base portion, and an engaging mechanism of an image reading device in a fourth illustrative embodiment according to one or more aspects of the disclosure.
Figure 15:
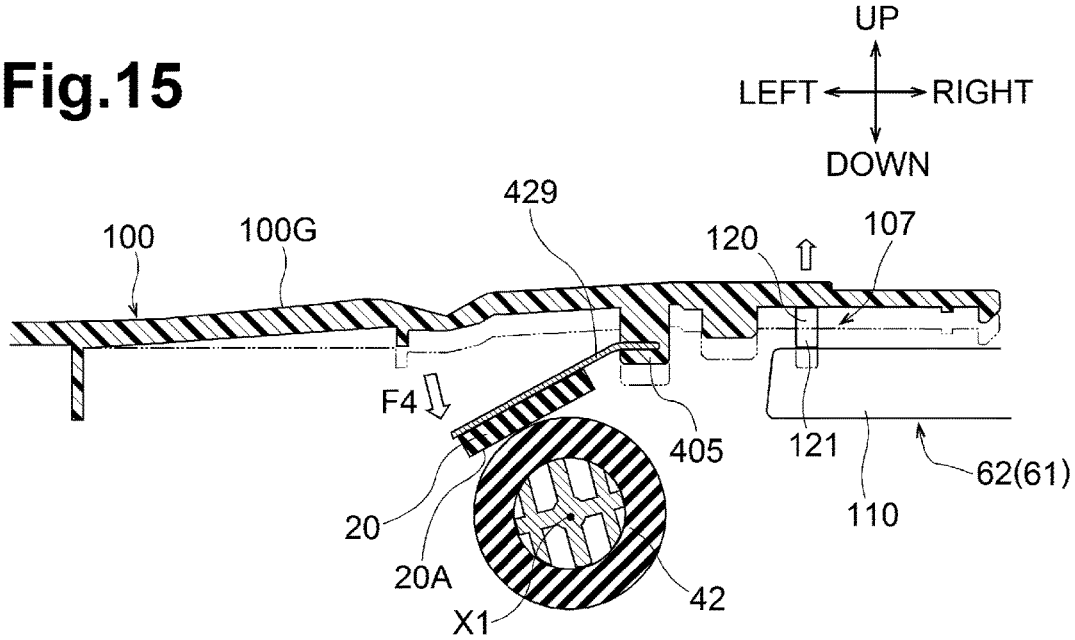
FIG. 15 is a partial sectional view depicting the separation roller, the separation pad, the leaf spring, the base portion, and the engaging mechanism of the image reading device in the fourth illustrative embodiment according to one or more aspects of the disclosure.

In an image reading device of a fourth illustrative embodiment, as depicted in FIGS. 14 and 15, a leaf spring 429 is used as the urging member instead of the compression coil spring 29 of the first illustrative embodiment. The leaf spring 429 also serves as a holder for holding a separation pad 20. Hereinafter, an explanation will be given mainly for the parts different from the first illustrative embodiment, and an explanation will be omitted for the common parts by assigning the same reference numerals thereto.

The leaf spring 429 may be, for example, a spring steel plate or a fiber-reinforced resin plate. A cover member 100 includes a base portion 405 at a lower surface thereof. The base portion 405 is disposed at the same position as the position where the retaining portion 100H of the first illustrative embodiment is disposed. A right end portion of the leaf spring 429 is fixed by the base portion 405. The leaf spring 429 has a generally plate-like shape and extends in a direction away from the base portion 405 (e.g., in the leftward direction) and also in the downward direction. A separation pad 20 is attached to a left end portion of a lower surface of the leaf spring 429.

The leaf spring 429 exerts an urging force F4 that urges the separation pad 20 toward the separation roller 42. The magnitude of the urging force F4 changes in response to an up-down movement of the base portion 405 when the actuating portions 110 and the receiving portions 120 constituting the engaging mechanism 107 behave as depicted in FIGS. 14 and 15.

The image reading device according to the fourth illustrative embodiment may provide the same effect as the effect that the image reading device 1 according to the first illustrative embodiment provides. In the image reading device according to the fourth illustrative embodiment, the leaf spring 429 as the urging member also serves as the holder for holding the separation pad 20, thereby reducing the parts count.

Fifth Illustrative Embodiment

Figure 16:
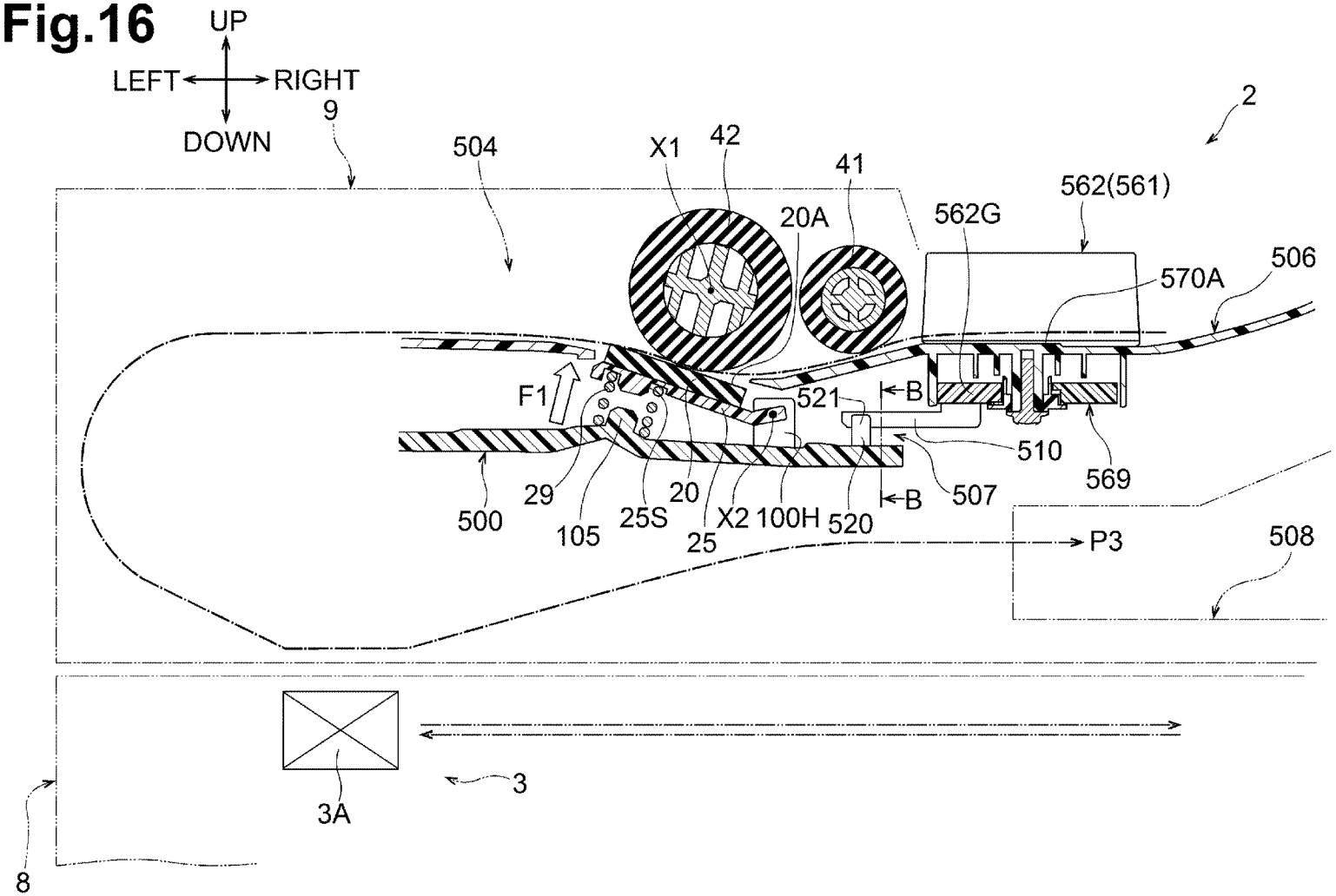
FIG. 16 is a schematic partial sectional view depicting a support member, a movable guide pair, a separation roller, a separation pad, a holder, a compression coil spring, a base portion, and an engaging mechanism of an image reading device in a fifth illustrative embodiment according to one or more aspects of the disclosure.

In an image reading device 2 of a fifth illustrative embodiment, as depicted in FIG. 16, an openable unit 9 includes a support member 506 having a similar configuration of the support member 6 of the first illustrative embodiment. A discharge portion 508 is disposed below the support member 506.

As depicted in FIGS. 16 and 17, the support member 506 has a support surface 570A, and a movable guide pair including a front movable guide 561 and a rear movable guide 562 is disposed on the support surface 570A. The movable guides 561 and 562 are supported by the support member 506 so as to be slidable in the front-rear direction. The movable guides 561 and 562 are joined to each other by a rack and pinion mechanism 569 disposed below the support surface 570A. The movable guides 561 and 562 are moved in respective directions such that the distance W in the front-rear direction therebetween increases to align one or more sheets SH supported by the support member 506 with respect to the center of the support member 506 in the front-rear direction.

The rear movable guide 562 includes a rack teeth 562G and an actuating portion 510. The rack teeth 562G constitutes a portion of the rack and pinion mechanism 569. The actuating portion 510 has a generally column shape and protrudes leftward from the rack teeth 562G.

As depicted in FIG. 16, a conveying unit 504 conveys, one by one, one or more sheets SH supported by the support member 506 along a conveying path P3 and discharges the one or more sheets SH to the discharge portion 508.

The conveying path P3 extends leftward from the support member 506 and then further extends curvedly downward to extend rightward. The conveying path P3 further extends to the discharge portion 508 while passing above the reading sensor 3A that is located at the fixed reading position within the main body 8.

In the conveying unit 504 of the fifth illustrative embodiment, a feed roller 41, a separation roller 42, a separation pad 20, a holder 25, a holder retaining portion 100H, a base portion 105, and a compression coil spring 29 are disposed symmetrically opposite to those of the first illustrative embodiment in the up-down direction. That is, the feed roller 41 and the separation roller 42 define an upper portion of the conveying path P3 near the support member 506 and the separation pad 20, the holder 25, the holder retaining portion 100H, the base portion 105, and the compression coil spring 29 define a lower portion of the conveying path P3 near the support member 506. A cover member 500 is disposed below the separation pad 20, the holder 25, the holder retaining portion 100H, the base portion 105, and the compression coil spring 29. The holder retaining portion 100H and the base portion 105 are disposed integral with an upper surface of the cover member 500. That is, in the fifth illustrative embodiment, the feed roller 41, the separation roller 42, the separation pad 20, the holder 25, the holder retaining portion 100H, the base portion 105, and the compression coil spring 29 behave in a similar manner to those of the first illustrative embodiment, so as to separate one or more sheets SH supported by the support member 506 into a single sheet SH and convey the single sheet SH along the conveying path P3.

Figure 18:
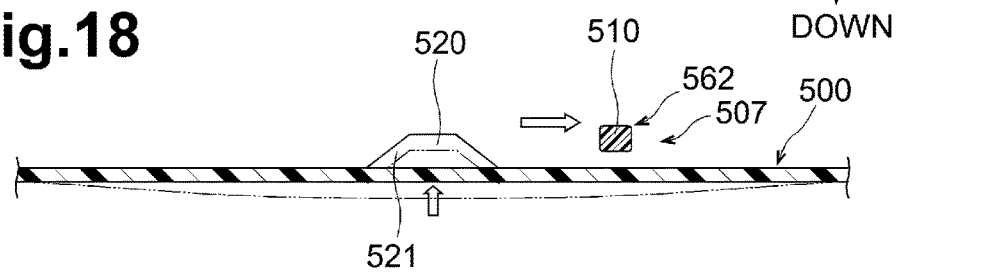
FIG. 18 is a schematic view taken along line B-B of FIG. 16 for explaining a behavior of the engaging mechanism of the image reading device in the fifth illustrative embodiment according to one or more aspects of the disclosure.
Figure 19:
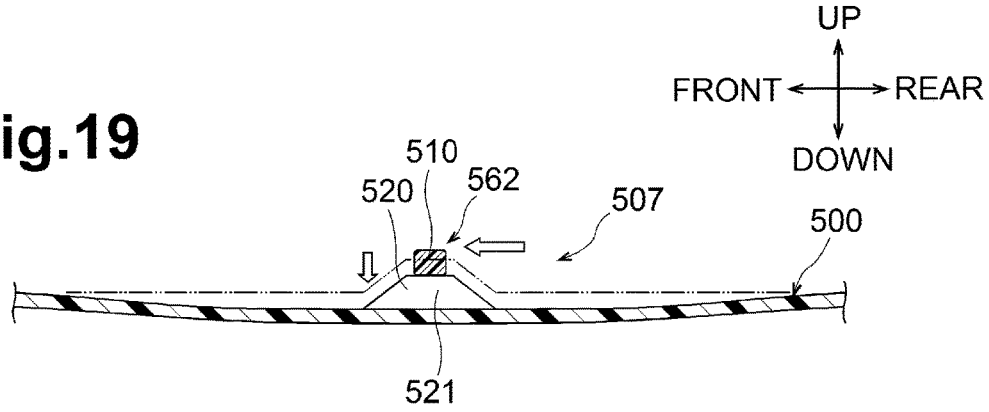
FIG. 19 is a schematic view taken along line B-B of FIG. 16 for explaining the behavior of the engaging mechanism of the image reading device in the fifth illustrative embodiment according to one or more aspects of the disclosure.
Figure 20:
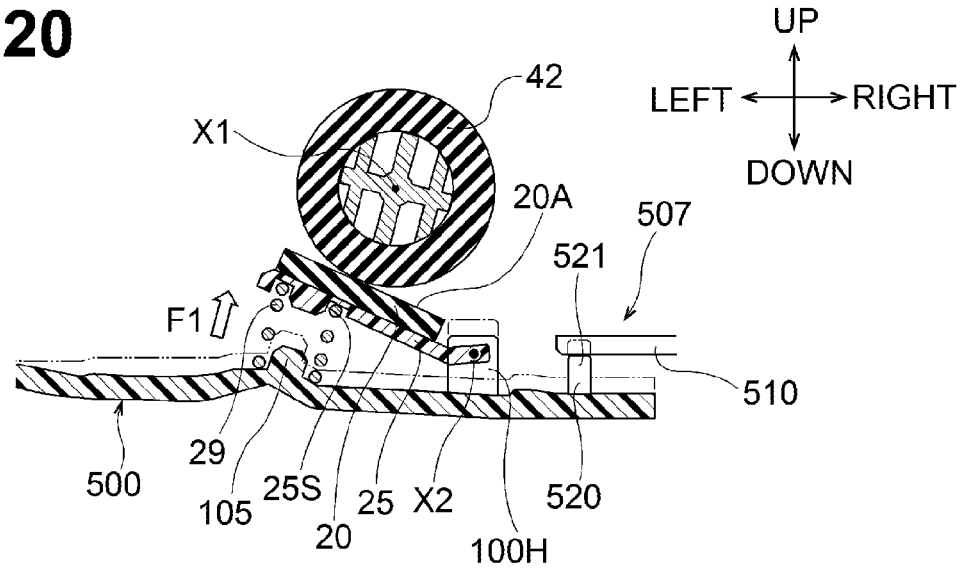
FIG. 20 is a partial sectional view depicting the separation roller, the separation pad, the holder, the compression coil spring, the base portion, and the engaging mechanism of the image reading device in the fifth illustrative embodiment according to one or more aspects of the disclosure.

The cover member 500 may be made of, for example, resin and have flexibility. The cover member 500 has a generally plate-like shape and is disposed on the same side as the separating pad 20 with respect to the separation roller 42. The cover member 100 extends facing the separation roller 42 from below. A front end and a rear end of the cover member 500 are fixed to a base member (not depicted) while a right end portion of the cover member 500 is free from movement. Thus, as depicted in FIGS. 18, 19, and 20, the right end portion of the cover member 500 is capable of warping downward away from the separation roller 42.

As depicted in FIGS. 16, 17, 18, 19, and 20, an engaging mechanism 507 is disposed between the movable guide pair including the movable guides 561 and 562 and the base portion 105. The engaging mechanism 507 includes an actuating portion 510 and a receiving portion 520.

The actuating portion 510 is integral with the rear movable guide 562 as described above.

As depicted in FIGS. 16, 18, 19, and 20, the receiving portion 520 is disposed integral with the upper surface of the cover member 500. The receiving portion 520 includes a rib-like protrusion 521 that protrudes upward and extends along the front-rear direction. The direction in which the protrusion 521 protrudes (e.g., the upward direction) is an example of a third direction.

Figure 17A:
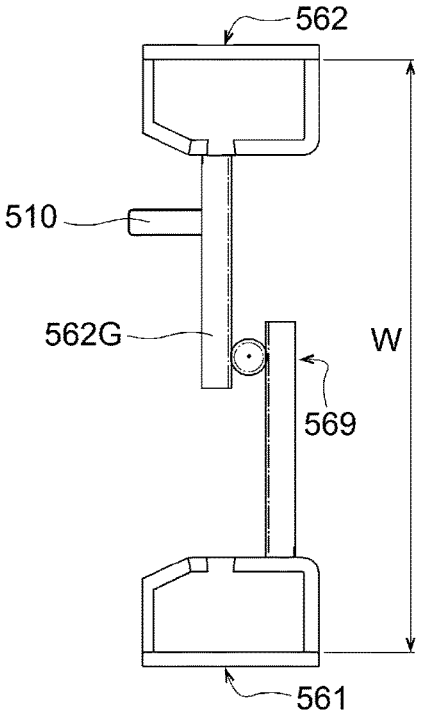
FIG. 17A is a schematic plan view depicting a movable guide pair and an actuating portion of an engaging mechanism of an image reading device in the fifth illustrative embodiment according to one or more aspects of the disclosure.

As depicted in FIG. 17A, in response to movement of the movable guides 561 and 562 in the respective directions that increase the distance W, the actuating portion 510 moves rearward together with the rear movable guide 562 as depicted in FIGS. 16 and 18. Due to this movement, the actuating portion 510 is located further to the rear than the receiving portion 520 and is spaced from the receiving portion 520. An upper end portion of the protrusion 521 constituting the receiving portion 520 is located higher than a lower end of the actuating portion 510.

Figure 17B:
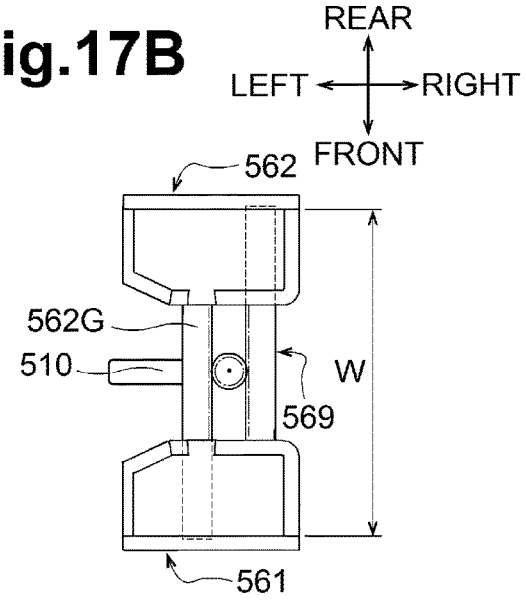
FIG. 17B is a schematic plan view depicting the movable guide pair and the actuating portion of the engaging mechanism of the image reading device in the fifth illustrative embodiment according to one or more aspects of the disclosure.

As depicted in FIG. 17B, in response to the movement of the movable guides 561 and 562 in the respective directions that decreases the distance W, the actuating portion 510 moves frontward together with the rear movable guide 562 as depicted in FIGS. 19 and 20. Due to this movement, the actuating portion 510 comes into contact with the receiving portion 520 to press down the receiving portion 520.

The downward pressing of the receiving portion 520 by the actuating portion 510 causes a right end portion of the cover member 500 to be warped downward further away from the separation roller 42. In response to this, the base portion 105 moves downward to away from the separation roller 42. Thus, the compression coil spring 29 becomes less compressed. Accordingly, the urging force F1 executed by the compression coil spring 29 becomes weaker. The direction in which the base portion 105 moves (e.g. the downward direction) in the fifth illustrative embodiment is another example of the first direction. In response to the downward movement of the base portion 105, the holder retaining portion 100H also moves downward further away from the separation roller 42. Therefore, the contacting posture of the separation pad 20 relative to the separation roller 42 is changed.

As depicted in FIGS. 16 and 18, the actuating portion 510 moves rearward relative to the receiving portion 520 and thus the actuating portion 510 does not press down the receiving portion 520. Therefore, the disengagement of the actuating portion 510 from the receiving portion 520 removes the warping of the cover member 500 to return the cover member 500 to its original position where the cover member 500 is located closer to the separation roller 42. With this movement, the base portion 105 moves upward toward the separation roller 42, and thus, the compression coil spring 29 becomes more compressed. Accordingly, the urging force F1 executed by the compression coil spring 29 is increased. The direction in which the base portion 105 moves (e.g., the upward direction) in the fifth illustrative embodiment is another example of the second direction.

The image reading device according to the fifth illustrative embodiment may provide the same effect as the effect that the image reading device 1 according to the first illustrative embodiment provides.

While the disclosure has been described in detail with reference to the illustrative embodiments thereof, they are merely examples, and various changes, arrangements and modifications may be applied therein without departing from the spirit and scope of the disclosure.

One end and the other end of the urging member may be retained by simply contacting respective particular positions while the urging member exerts its urging force in a compressed state. The first direction and the second direction are not limited to the directions according to the first to fifth illustrative embodiments. For example, in a case where the second end portion 329B of the torsion coil spring 329 of the second illustrative embodiment extends upward in the vertical direction, the first direction and the second direction extends substantially parallel to the horizontal direction.

In the above-described illustrative embodiments, the cover members 100 and 500 are an injection molded member made of thermoplastic resin. Nevertheless, in other embodiments, for example, a cover member made of other materials, for example, metallic material may be used so long as the cover member has flexibility.

In the first illustrative embodiment, the separation pad 20 is supported by the holder 25 and the lower end of the compression coil spring 29 is retained by the holder 25. Nevertheless, in other embodiments, for example, one end of an urging member may be retained by a separation member directly. In still other embodiments, for example, an urging member, for example, a compression coil spring or a leaf spring, may be disposed integrally with one of a separation member and a base portion.

In the above-described illustrative embodiments, both of the front movable guide 61 or 561 and the rear movable guide 62 or 562 are movable so as to align sheets with respect to the center of the support member 6 in the front-rear direction. Nevertheless, in other embodiments, for example, one of a front guide and a rear guide may be movable so as to align sheets with respect to one side of a support member in a front-rear direction.

The disclosure may also be applied to, for example, an image reading device, an image forming apparatus, and a multifunction device.

What is claimed is:

1. A sheet separating device comprising:

a support member configured to support sheets to be conveyed in a conveying direction;

a first guide and a second guide opposing each other with a distance therebetween in a width direction orthogonal to the conveying direction, at least one of the first guide and the second guide being a movable guide configured to move in the width direction to increase and decrease the distance;

a separation roller configured to rotate about a first axis and convey a sheet supported by the support member in the conveying direction;

a separation member configured to separate the sheet conveyed by the separation roller from remaining sheets;

a base portion;

an urging member retained, at one end thereof, by the base portion in an elastically deformed state and urging the separation member toward the separation roller;

a platelike member which is flexible and faces the separation roller with the separation member disposed therebetween, the platelike member including the base portion; and an engaging mechanism disposed between the movable guide and the base portion and configured to:

in response to the movable guide decreasing the distance between the first guide and the second guide, reduce elastic deformation of the urging member by moving the base portion in a first direction, wherein moving the base portion in the first direction includes warping the platelike member in a direction away from the separation roller, and in response to the movable guide increasing the distance between the first guide and the second guide, move the base portion in a second direction opposite to the first direction by cancelling warping of the platelike member.

2. The sheet separating device according to claim 1, wherein the engaging mechanism includes an actuating portion disposed in the movable guide, and a receiving portion disposed in the platelike member, the actuating portion being configured to move together with the movable guide decreasing the distance and to press the receiving portion in the direction away from the separation roller.

3. The sheet separating device according to claim 2, wherein one of the actuating portion and the receiving portion includes a protrusion which protrudes in a third direction and is configured to contact the other of the actuating portion and the receiving portion.

4. The sheet separating device according to claim 3, wherein an end face of the protrusion in the width direction is inclined relative to the third direction such that a portion of the end face closer to a center of the protrusion in the width direction protrudes further in the third direction.

5. The sheet separating device according to claim 3, wherein the protrusion includes a plurality of protruding portions which have different protruding lengths in the third direction.

6. The sheet separating device according to claim 1, wherein the engaging mechanism is configured to move the base portion in the first direction away from the separation member and in the second direction toward the separation member.

7. The sheet separating device according to claim 1, wherein the urging member comprises a spring configured to be variably compressed to change an urging force to the separation member.

8. The sheet separating device according to claim 1, wherein the separation member includes:

a separation pad having a contact surface configured to contact the sheet and apply a friction force to the sheet; and a holder holding an opposite side of the separation pad from the contact surface.

9. The sheet separating device according to claim 8, wherein the holder is configured to pivot about a second axis parallel to the first axis such that the separation member moves toward and away from the separation roller, and wherein the other end of the urging member is retained by the holder.

10. The sheet separating device according to claim 1, wherein the urging member comprises a plate spring extending from one end retained by the base portion to the other end to which the separation member is pasted.

11. The sheet separating device according to claim 1, further comprising a reading unit disposed downstream of the separation roller in the conveying direction and configured to read an image of the sheet conveyed by the separation roller.

12. The sheet separating device according to claim 1, wherein the first axis of the separation roller is located above the separation member.

13. A sheet separating device comprising:

a support member configured to support sheets to be conveyed in a conveying direction;

a first guide and a second guide opposing each other with a distance therebetween in a width direction orthogonal to the conveying direction, at least one of the first guide and the second guide being a movable guide configured to move in the width direction to increase and decrease the distance;

a separation roller configured to rotate about a first axis and convey a sheet supported by the support member in the conveying direction;

a separation member configured to separate the sheet conveyed by the separation roller from remaining sheets;

a base portion;

an urging member retained, at one end thereof, by the base portion and configured to urge the separation member toward the separation roller;

a platelike member which is flexible and faces the separation roller with the separation member disposed therebetween, the platelike member including the base portion; and an engaging mechanism disposed between the movable guide and the base portion and configured to:

in response to the movable guide decreasing the distance between the first guide and the second guide, reduce an urging force of the urging member by moving the base portion in a first direction, wherein moving the base portion in the first direction includes warping the platelike member in a direction away from the separation roller, and in response to the movable guide increasing the distance between the first guide and the second guide, increase the urging force of the urging member by moving the base portion in a second direction opposite to the first direction by cancelling warping of the platelike member.

14. A sheet separating device comprising:

a support member configured to support sheets to be conveyed in a conveying direction;

a first guide and a second guide opposing each other with a distance therebetween in a width direction orthogonal to the conveying direction, at least one of the first guide and the second guide being a movable guide configured to move between a first position and a second position in the width direction;

a separation roller configured to rotate about a first axis and convey a sheet supported by the support member in the conveying direction;

a separation member configured to separate the sheet conveyed by the separation roller from remaining sheets;

an urging member configured to urge the separation member toward the separation roller; and a platelike member facing the separation roller with the separation member disposed therebetween, the platelike member including a base portion retaining one end of the urging member and movable between a third position and a fourth position, wherein the base portion of the platelike member is configured to move from the third position to the fourth position in response to the movable guide moving from the first position to the second position, the base portion, when at the third position, being closer to the separation roller than when at the fourth position, and the movable guide, when at the first position, defining a greater distance between the first guide and the second guide than when at the second position, and wherein the movable guide includes an actuating portion and the platelike member further includes a receiving portion, the actuating portion being configured to make contact with the receiving portion when the movable guide moves from the first position to the second position, and to move away from the receiving portion when the movable guide moves from the second position to the first position.

15. The sheet separating device according to claim 14, wherein the platelike member is configured to be warped away from the separation roller when the actuating portion makes contact with the receiving portion.

* * * * *